US006195919B1

(12) United States Patent
Forrest et al.

(10) Patent No.: US 6,195,919 B1
(45) **Date of Patent: *Mar. 6, 2001**

(54) MOUNTAINEERING SNOWSHOE

(75) Inventors: Bill Forrest, Denver, CO (US); Jane A. Verrall, Seattle, WA (US); Robert Lowry, Englewood, CO (US)

(73) Assignee: Mountain Safety Research, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/294,465

(22) Filed: Apr. 20, 1999

Related U.S. Application Data

(63) Continuation of application No. 08/734,327, filed on Oct. 21, 1996, now Pat. No. 5,921,007, which is a continuation-in-part of application No. 08/645,197, filed on May 13, 1996, now abandoned, which is a continuation of application No. 08/209,383, filed on Mar. 10, 1994, now Pat. No. 5,531,035, which is a continuation-in-part of application No. 08/141,853, filed on Oct. 22, 1993, now Pat. No. 5,469,643, which is a continuation-in-part of application No. 08/194,983, filed on Feb. 10, 1994, now Pat. No. 5,517,773.

(51) Int. Cl.[7] ..... A43B 5/04; A43B 5/16; A43B 3/26

(52) U.S. Cl. ..... 36/122; 36/123; 36/124; 36/97; 36/116

(58) Field of Search ..... 36/122, 123, 124, 36/125, 97, 116

(56) References Cited

U.S. PATENT DOCUMENTS

| | | |
|---|---|---|
| 405,516 | 6/1889 | Watson . |
| 736,082 | 8/1903 | Foreman . |
| 1,004,900 | 10/1911 | Pease . |
| 1,014,482 | 1/1912 | Kaminski . |

(List continued on next page.)

FOREIGN PATENT DOCUMENTS

| | | |
|---|---|---|
| 634114 | 1/1962 | (CA) . |
| 1080760 | 7/1980 | (CA) . |
| 27 04 858 | 8/1978 | (DE) . |
| 0 613 704 | 9/1994 | (EP) . |
| 77 03933 | 9/1977 | (FR) . |

OTHER PUBLICATIONS

The Snowshoe Book, Third Edition, by William Osgood and Leslie Hurley, 1971.

*Primary Examiner*—Paul T. Sewell
*Assistant Examiner*—Anthony Stashick
(74) *Attorney, Agent, or Firm*—Foster & Foster

(57) ABSTRACT

The novel snowshoe (400) includes at least one tail extender (404) to provide variable flotation characteristics and traction bars (412) that provide improved side slip protection such as when traversing steep terrain. The snowshoe (400) is thereby especially advantageous for use in back country mountaineering. A three (or more) point attachment mechanism is disclosed for coupling the tail extender (404) to the flotation plate (416) of snowshoe (400) so as to reduce stress on the coupling elements and provide a more secure interface.

14 Claims, 18 Drawing Sheets

U.S. PATENT DOCUMENTS

| | | | |
|---|---|---|---|
| 1,038,264 | 9/1912 | Baker . | |
| 1,052,139 | 2/1913 | Emack . | |
| 1,230,447 | 6/1917 | Tuttle . | |
| 1,542,496 | 6/1925 | Foster . | |
| 1,630,041 | 5/1927 | Vose . | |
| 2,486,868 | 11/1949 | Mueller | 36/4.5 |
| 2,511,087 | 6/1950 | Villemur | 36/4.5 |
| 2,619,742 | 12/1952 | Cumming | 36/4.2 |
| 2,738,596 | 3/1956 | Walsh | 36/4.5 |
| 2,769,250 | 11/1956 | Rinkinen | 36/4.5 |
| 3,299,541 | 1/1967 | Snyder | 36/4.5 |
| 3,600,829 | 8/1971 | LaViolette | 36/4.5 |
| 3,673,713 | 7/1972 | Fedewitz | 36/2.5 AB |
| 3,755,927 | 9/1973 | Dearborn | 36/2.5 AB |
| 3,760,513 | 9/1973 | Corneliusen | 36/2.5 AB |
| 3,802,100 | 4/1974 | Prater | 36/2.5 AB |
| 3,861,698 | 1/1975 | Greig | 280/11.13 Y |
| 4,004,355 | 1/1977 | Koblick | 36/122 |
| 4,041,622 | 8/1977 | Schonbrun | 36/124 |
| 4,045,889 | 9/1977 | Woolworth | 36/122 |
| 4,085,529 | 4/1978 | Merrifield | 36/125 |
| 4,178,925 * | 12/1979 | Hirt | 36/97 |
| 4,259,793 | 4/1981 | Morgan, Jr. et al. | 36/125 |
| 4,271,609 | 6/1981 | Merrifield | 36/125 |
| 4,349,923 | 9/1982 | Knapp et al. | 36/123 |
| 4,351,121 | 9/1982 | Wallace | 36/125 |
| 4,604,817 | 8/1986 | Romobz | 36/125 |
| 5,014,450 | 5/1991 | McGrath | 36/124 |
| 5,251,388 | 10/1993 | Pozzobon et al. | 36/50.5 |
| 5,253,437 | 10/1993 | Klebahn | 36/122 |
| 5,259,128 | 11/1993 | Howell | 36/122 |
| 5,309,652 | 5/1994 | Campbell | 36/124 |
| 5,341,582 | 8/1994 | Liautaud | 36/36 |
| 5,459,950 | 10/1995 | Damm | 36/122 |
| 5,493,794 | 2/1996 | McKenzie et al. | 36/122 |
| 5,517,772 | 5/1996 | Anderson | 36/36 |
| 5,542,197 | 8/1996 | Vincent | 36/36 |
| 5,687,491 | 11/1997 | Klebahn | 36/36 |
| 5,901,471 | 5/1999 | Warner | 36/36 |

* cited by examiner

MOUNTAINEERING SNOWSHOE

RELATED INFORMATION

This application is a continuation of U.S. patent application Ser. No. 08/734,327 filed Oct. 21, 1996 (U.S. Pat. No. 5,921,007) which is a continuation-in-part of co-pending U.S. patent application Ser. No. 08/645,197 filed May 13, 1996 which is a Continuation of U.S. patent application Ser. No. 08/209,383, filed on Mar. 10, 1994 (U.S. Pat. No. 5,531,035), which is a continuation-in-part of U.S. patent application Ser. No. 08/141,853 filed on Oct. 22, 1993 (U.S. Pat. No. 5,469,643) and U.S. patent application Ser. No. 08/194,983 filed on Feb. 10, 1994 (U.S. Pat. No. 5,517,773).

FIELD OF THE INVENTION

The present invention relates generally to snowshoeing and, in particular, to a novel snowshoe and binding which provides improved foot stability (especially heel stability), adjustable flotation characteristics, improved side, forward and reverse slip protection, forward tracking guidance and overall stability and lightweight material options. The invention is especially well-suited for back-country mountaineering where side-slip protection and variable flotation characteristics take on greater, if not critical, importance.

BACKGROUND OF THE INVENTION

According to some historians, the first snowshoes were developed about 6,000 years ago in Central Asia. Snowshoes have been used in North America for many centuries, first by native American peoples and later by trappers, explorers and other European settlers. Traditionally, snowshoes were formed from light oval or teardrop shaped wooden frames strung with thongs made from animal hide. The resulting snowshoe could then be strapped to a person's foot, i.e., directly or via footgear, so as to enable the person to walk in soft snow without sinking too deeply.

Today, snowshoes are most commonly used for recreation and by mountaineers to facilitate winter access to remote back country locations. Although the materials and production techniques have changed, modern snowshoes have much in common with traditional snowshoes developed over the centuries. FIG. 1 illustrates some features of one type of snowshoe 1 in common use today. The general shape of the snowshoe 1 is defined by a tubular perimeter structure 2 which is ordinarily formed from aluminum. The requisite flotation surface area is typically provided by webbing or a platform 3, formed from animal hide or synthetic materials, which is connected to the tubular perimeter structure 2 via sturdy lacing 4 or rivets. The snowshoe 1 is attached to the wearer's foot via footgear 5 using a toe strap 6, and an additional heel strap 7 is usually provided. Often, a hinged metal device or so-called crampon 8 which extends through an opening 9 in platform 3 is provided to improve forward traction on hills or ice.

Despite the long evolution of the snowshoe art, current snowshoes are subject to certain limitations. For example, when the snowshoer traverses a steep hill, current snowshoes are highly susceptible to side slippage. Similarly, current snowshoes can slip forwardly or rearwardly when a hill is addressed directly, particularly in icy conditions. In addition to being a source of annoyance, such slipping can be a matter of grave safety concern for the back country mountaineer. Conventional snowshoes do not always provide adequate protection against forward, rearward and side slippage.

Another limitation of current snowshoes is that the snowshoes have invariable flotation characteristics relating to the size of the snowshoe. However, the desired flotation characteristics of a snowshoe vary from user-to-user, from application-to-application, and depending on snow conditions or other factors. For example, a larger snowshoe is normally better for a heavier snowshoer, when carrying a heavy pack or when snowshoeing in deep and soft snow. Smaller snowshoes are typically preferred for running or racing (as is becoming increasingly popular). Many avid snowshoeing enthusiasts therefore have more than one pair of snowshoes. This is not a completely satisfactory situation for a number of reasons. First, the expense of acquiring more than one pair of snowshoes is prohibitive for many. In addition, the snowshoer cannot always accurately predict what conditions may be encountered during an outing. Snow conditions can change rapidly, particularly in back-country mountaineering expeditions involving large altitude changes. Moreover, for outings lasting several days, conditions may change due to storms, wind, temperature changes and other weather phenomena. Furthermore, as can be readily appreciated, it is not always convenient to store and carry more than one pair of snowshoes.

Current snowshoes as described above are also subject to a certain instability relating to snow compaction. In particular, as the snowshoer places weight on the snowshoe, the platform tends to flex to a concave shape. As a result, snow may be forced towards the snowshoe perimeter rather than providing stable support under the snowshoer's foot.

Additionally, current snowshoes tend to create resistance to the shuffling movement entailed in forward snowshoeing. In this regard, the tubular perimeter and angled orientation of common snowshoe perimeter structures result in snow plowing when the snowshoe is shuffled in a forward direction. Moreover, current snowshoes generally do not facilitate forward tracking, i.e., even on flat ground, current snowshoes can easily drift transversely to the desired direction of travel during shuffling.

The snowshoe binding has also presented persistent challenges for snowshoe designers as many desired binding qualities seemingly demand incompatible design features. For example, the binding must be able to securely accommodate a variety of footgear sizes and styles in order to be suitable for general use. However, in order to facilitate proper snowshoeing motion and reduce strain on the snowshoer, the binding must provide excellent lateral foot stability, limit vertical movement of the snowshoer's footgear, and limit forward or rearward slipping of the footgear as may occur in hilly terrain. In addition, it is highly desirable to provide a binding which can be quickly and easily attached and detached even though the snowshoer's finger dexterity may be limited due to coldness or handgear.

Accordingly, there is a need for an improved snowshoe which addresses the limitations and challenges facing snowshoe designers.

SUMMARY OF THE INVENTION

The snowshoe of the present invention provides variable flotation characteristics, improved protection against slipping especially side slipping when traversing steep terrain, improved forward tracking guidance and overall stability and reduced weight. In addition, the present invention includes a binding which is easy to construct and use, yet is capable of securely and stably engaging a variety of footgear and footgear sizes.

According to one aspect of the present invention, the snowshoe includes a flotation surface and a pair of traction bars mounted on the flotation surface and projecting downwardly from the flotation surface. The flotation surface is preferably formed from one or more sheets of lightweight and rigid or semi-rigid material such as thermal formed plastic. The traction bars, which can be formed as an integral portion of the flotation plate or formed as separate pieces for attachment to the flotation plate, are laterally spaced for stability. In one embodiment, the flotation surface has an opening through which a crampon and a forward portion of the snowshoer's foot can project, and the traction bars are positioned adjacent to the side edges of the opening. The traction bars extend substantially linearly along the length of the flotation plate and preferably have narrow bottom and frontal profiles. In addition, the traction bars have a length which is at least about equal to the length of the snowshoer's foot. The traction bars can also include a lower edge having indentations, e.g., teeth, for improved traction. The traction bar indentations are preferably formed with rounded extremities for improved fracture resistance.

The traction bars provide a number of advantages relative to conventional snowshoes. First, the traction bars penetrate into the snow during use and thereby afford positive protection against sideslipping. The traction bars therefore provide for greater safety when traversing steep terrain. The traction bars also impart improved torsional rigidity to the flotation plate so that the material requirements of the flotation plate can be reduced and a lighter weight snowshoe can be achieved. Moreover, the crampon can be connected to the traction bars thereby shortening the crampon connection and reducing strain on the connection assembly. The traction bars also penetrate the snow during shuffling movement substantially without plowing and contribute to forward tracking guidance. By providing a toothed lower edge on the traction bars, improved traction and protection against forward or rearward slipping can also be imparted.

According to another aspect of the invention, a snowshoe with variable flotation characteristics is provided. The snowshoe comprises a flotation plate and at least one extension member which is detachably coupled to the flotation plate for selectively increasing the snow contact surface area of the snowshoe. Preferably, more than one extension member is provided to allow for a variety of snow contact surface areas. In one embodiment, the extension members comprise tail extenders which can be attached to a rearward portion of the flotation plate to increase the length of the snowshoe. An alignment mechanism can be provided to assist in attachment of the extension members and to insure stable alignment of the extension members during use. For example, the alignment members may comprise a mating coupling between the flotation plate and the extension members. In a preferred embodiment, the flotation plate and extension member are secured together at at least three locations spaced across the width of the snowshoe. Such attachment has been found to maintain a more positive contact between the flotation plate and extension member during use. For ease of extension member connection and disconnection, at least one of the interconnections can be accomplished by way of a sliding or snapping engagement mechanism. One such embodiment employs a spool on one of the flotation plate and extension member for engaging a groove on the other of the flotation plate or extension member. Although a particular embodiment of the variable length snowshoe is described below, it will be appreciated that the variable length concept is applicable to various types of snowshoes.

Another aspect of the present invention relates to providing a snowshoe binding with improved lateral foot stability. It has been found that certain snowshoe bindings are susceptible to lateral foot instability during use. In particular, the wearer's heel may tend to move from side-to-side relative to the snowshoe, particularly when traversing a steep side slope. This problem is addressed in accordance with the present invention by providing a binding including a flexible footwrap attached to a support member which underlies the wearer's foot, wherein the support member has a length sufficient to underlie a majority of the wearer's foot. Preferably, the support member is at least about six inches in length and the footwrap is attached to the support member at least adjacent to the front and back ends thereof. This length can be provided via a heel extension which extends beneath the arch of the wearer's foot to or towards the wearer's heel. It will be appreciated that the majority of the support surface, which is pivotably connected to the snowshoe, will lie behind the pivot point. The footwrap is secured to the wearer's footgear by way of one or more straps that extend over the wearer's footgear and, preferably, around the heel of the footgear. In one embodiment, the strap(s) extends from the footwrap on one side of the footgear and is threaded through a receiving structure mounted on the footwrap on the other side of the footgear. A stopper can be provided on the strap to prevent the strap from becoming unthreaded when the strap is loosened. The strap coupling of the present invention allows for easy engagement and disengagement, even when the user is wearing gloves or mittens or when the user's finger dexterity is limited due to cold weather or otherwise. Alternatively, a strapless step-in binding, such as used in connection with snowboards, may be employed.

DETAILED DESCRIPTION OF THE INVENTION

Figure 1:
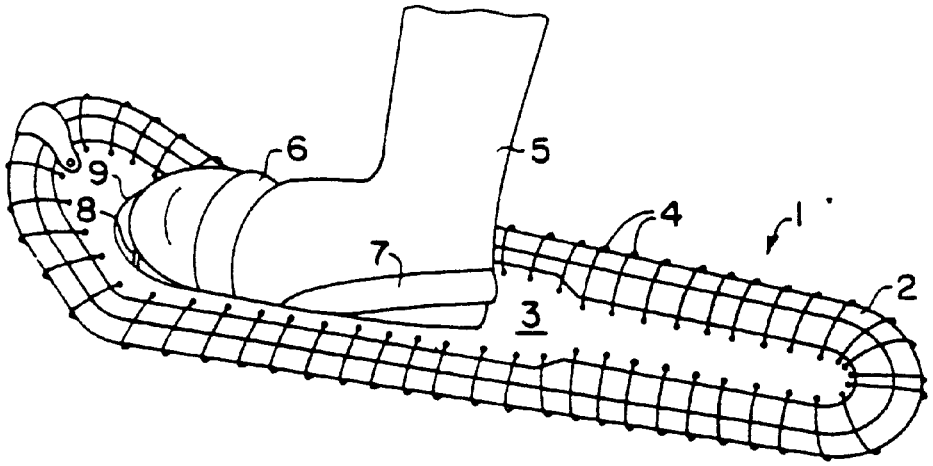
FIG. 1 PRIOR ART
FIG. 1, as described in the Background of the Invention, illustrates some features of one type of prior art snowshoe.
Figure 2:
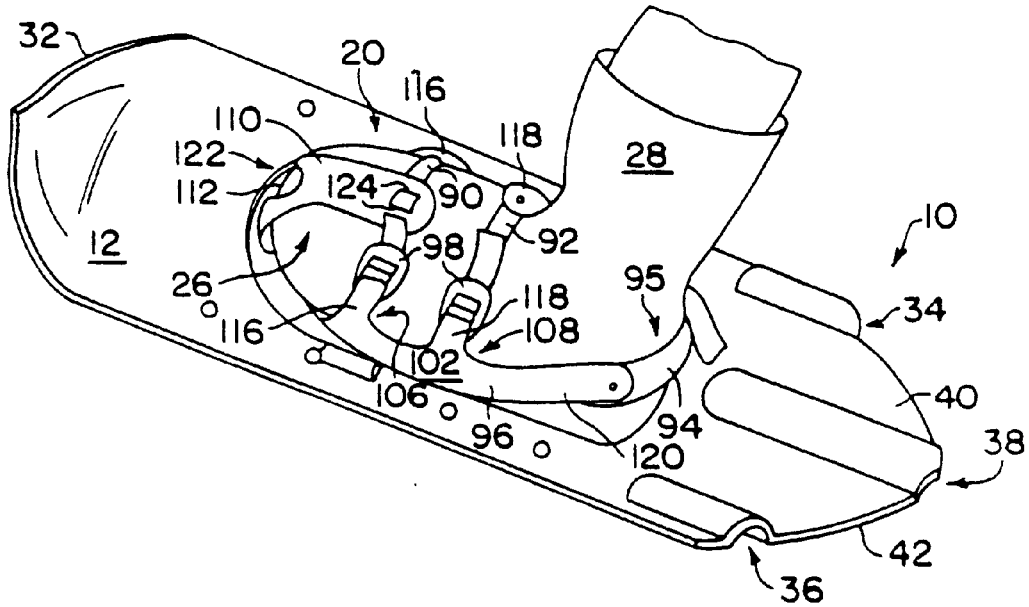
FIG. 2 is a perspective view of a snowshoe constructed in accordance with the present invention.
Figure 3:
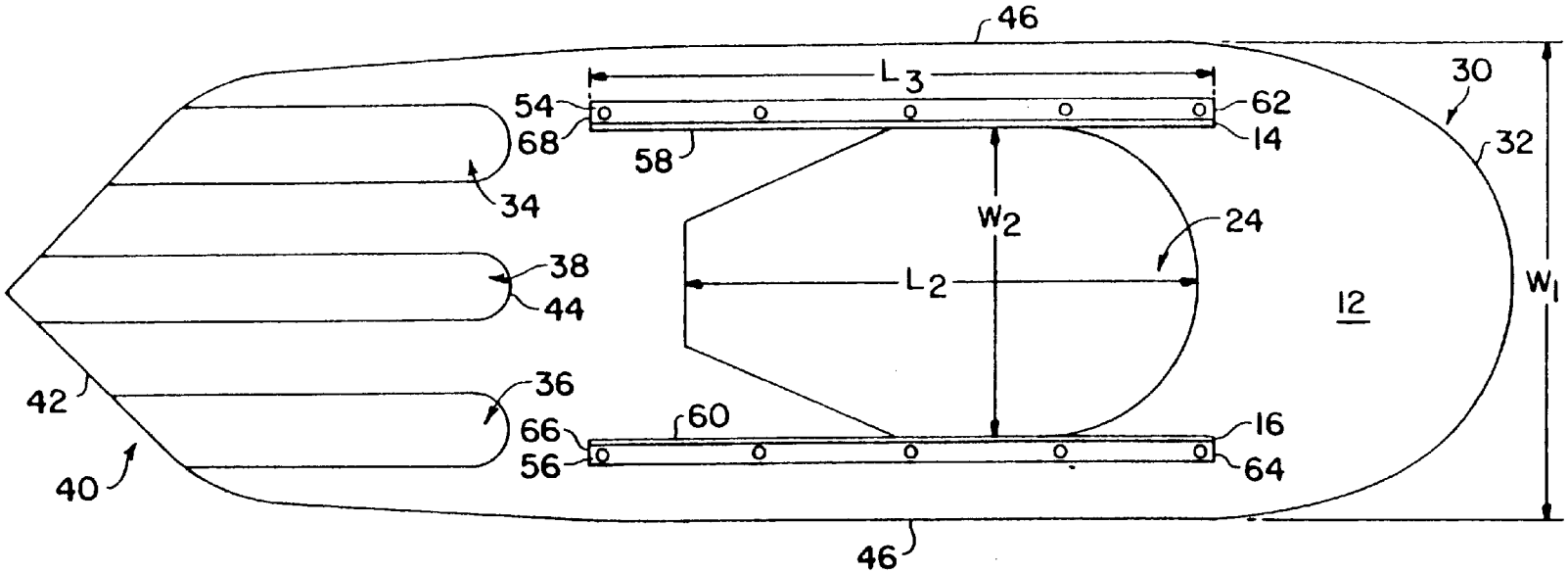
FIG. 3 is a bottom view showing the flotation plate and traction bars of the snowshoe of FIG. 2.
Figure 4:
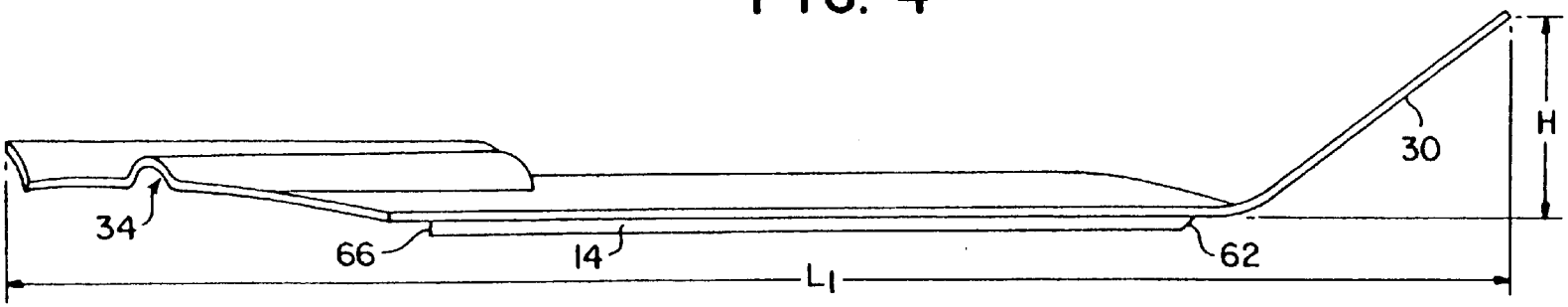
FIG. 4 is a side view of the flotation plate and traction bars of the snowshoe of FIG. 2.

Referring to FIGS. 2–8, a snowshoe constructed in accordance with the present invention is generally identified by the reference numeral 10. Generally, the snowshoe 10 comprises a flotation plate 12, traction bars 14 and 16, a crampon 18 and a binding 20. In the illustrated embodiment, the binding is designed for attachment to a snowshoer's footgear 28.

The flotation plate 12 can be formed from any of various lightweight semi-rigid materials such as various plastics. The illustrated flotation plate 12 is formed from 3/16 or 1/8 inch thick thermal formed, high density polyethylene which provides adequate strength and rigidity and allows for simple and inexpensive construction. The overall dimensions of the flotation plate 12 can be varied depending on the weight or skill of the snowshoer, the size of the snowshoer's footgear 28, local snow conditions, the load being carried or other factors. In this regard, the snowshoe 10 can be provided, for example, in various lengths (e.g., 22 inches, 26 inches or 30 inches) and widths (e. g., 8 inches or 9 inches) to accommodate a range of conditions. The illustrated flotation plate 12 has a length $L_1$, of about 26 inches and a width $W_1$ of about 8 inches.

The shape of the flotation plate 12 is further defined by a number of molded curves and channels and a central cut-out 24. The cut-out 24 is provided to allow the crampon 18 and a toe section 26 of the snowshoer's footgear 28 to extend through the flotation plate 12 for improved traction. The illustrated cut-out 24 has a length $L_2$ of about 8.75 inches and a width of about 5.25 inches. The flotation plate 12 can also be provided with perforations (not shown) to minimize snowshoe weight.

In order to facilitate forward shuffling of the snowshoe 10 through snow, the tip portion 30 of the flotation plate 12 adjacent leading edge 32 is curved upwardly. The upward curve begins just forward of the cut-out 24, about 5 inches from leading edge 32. The curve defines an approximately 36° angle relative to horizontal such that the forward most point of leading edge 32 is elevated to a height H of about 3.75 inches relative to the base of flotation plate 12. As will be better understood upon consideration of the description below, the upward curve is actually a compound curve resulting from the blending of the upward tip projection and the overall convex frontal profile of the flotation plate 12 as can be see in FIG. 5.

In the illustrated embodiment, the flotation plate 12 further includes a pair of side channels 34 and 36 and a central channel 38, each of which extends along a rear portion 40 of the flotation plate 12 to rear edge 42. The channels are formed as recesses into the underside of flotation plate 12. The illustrated central channel is about ½–¾ inch wide, ½–¾ inch deep and its front edge 44 is located rearwardly from cut-out 24. The side channels 34 and 36 are slightly smaller than the central channel 38, e.g., about ⅜–½ inch wide and ⅜–½ inch deep. During forward travel,, snow passes through the channels 34, 36 and 38 and exits at the rear edge 42 of the snowshoe 10 such that the channels 34, 36 and 38 enhance forward tracking guidance. These channels 34, 36 and 38 also add rigidity to the rear portion 40 of the flotation plate 12.

In an alternative embodiment (not shown), the side channels are eliminated, the traction bars extend further towards the rear edge of the flotation plate and the central channel is enlarged. In addition, the central channel has a tapered profile which extends upwardly relative to the flotation plate such that the snowshoer's footgear is urged forwardly due to the taper inclination.

Figure 5:
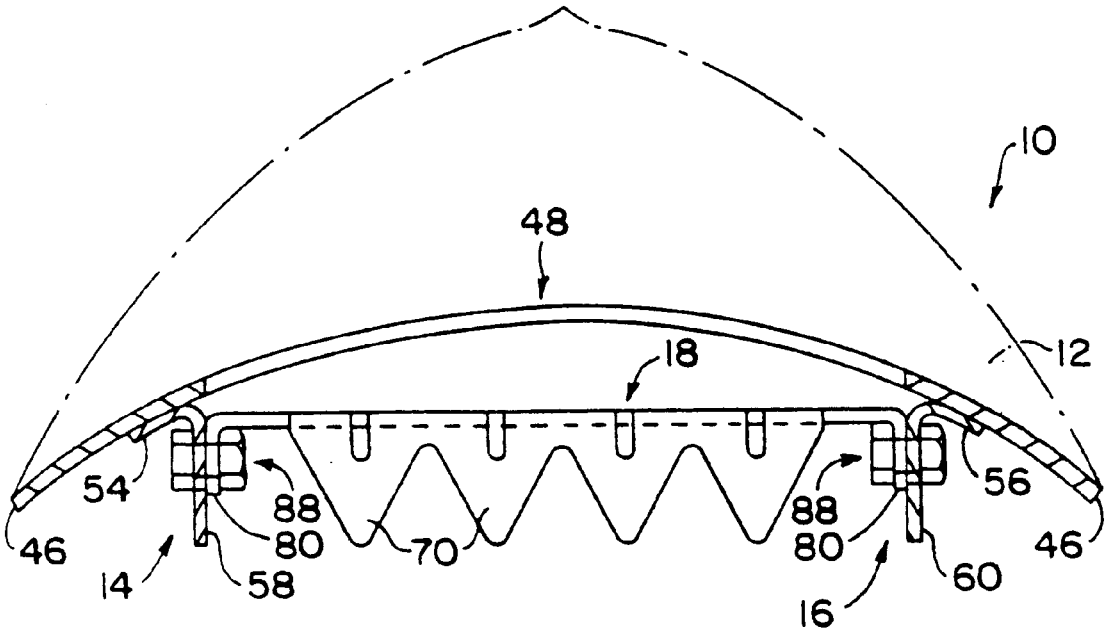
FIG. 5 is a cut-away front view of the flotation plate, traction bars and crampon of the snowshoe of FIG. 2.
Figure 7:
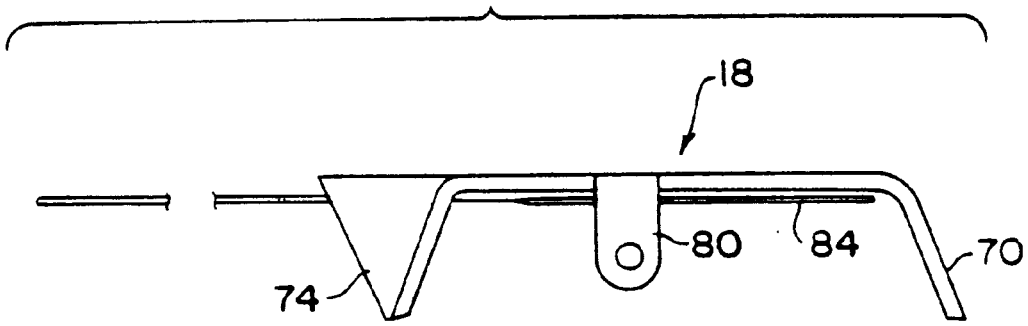
FIG. 7 is a side view of the crampon of the snowshoe of FIG. 2.

As can be most clearly seen in FIG. 5, the flotation plate 12 has a convex frontal profile such that the side edges 46 are positioned lower than a central portion 48 of the flotation plate 12. In the illustrated embodiment, this profile is defined by a radius of curvature of about 12 inches. When the snowshoer places weight on the snowshoe 10 thereby forcing the flotation plate 12 downwardly into the snow, the convex frontal profile causes snow to gather or move towards the center of the flotation plate 12 so that a stable snow platform is provided beneath the snowshoer's foot. In addition, as the snowshoer shuffles forwardly, the convex flotation plate 12 forms a snow ridge which further assists in forward tracking guidance.

The snowshoe 10 further includes a pair of traction bars 14 and 16 which project downwardly from flotation plate 12. The traction bars 14 and 16 can be molded into flotation plate 12 or formed separately for attachment to flotation plate 12. The illustrated traction bars 14 and 16 are formed from 3/32 inch thick aluminum or other metal and are attached to flotation plate 12 via rivets, screws or other fasteners extending through traction bar flanges 54 and 56 into flotation plate 12. The traction bars 14 and 16 thereby have narrow frontal and bottom profiles which facilitate snow penetration. The angle between each of the flanges 54 and 56 and the corresponding downward projections 58 and 60 of traction bars 14 and 16 is formed such that the projections 58 and 60 extend substantially vertically downward when the flanges 54 and 56 are attached to the convex lower surface of flotation plate 12.

The traction bars 14 and 16 preferably have a length $L_3$ which is at least about as great as the length of the snowshoer's footgear 28. In this regard, the illustrated traction bars 14 and 16 are about 12 inches long and are positioned such that the front edges 62 and 64 thereof are about ½ inch forward from cut-out 24. The traction bars extend substantially linearly from the front edges 62 and 64 to the rear edges 66 and 68 thereof and are oriented parallel to the direction of forward travel so that substantially no snow plowing occurs during shuffling. In addition, the front edges 62 and 64 in the illustrated embodiment are beveled to further facilitate snow penetration and to allow the traction bars 14 and 16 to smoothly ride up over obstructions.

The depth of the downward projections 58 and 60 is selected such that the traction bars 14 and 16 provide protection against side slipping of the snowshoe 10 and also allow for extension of the crampon 18 below the traction bars 14 and 16 for improved forward traction on hills or ice or braking when descending same. Furthermore, the depth of the traction bars 14 and 16 is preferably about equal to the depth of the crampon claws when the crampon 18 is in a level orientation. The illustrated traction bars 14 and 16 extend downwardly about 9/10 inch from flotation plate 12. If desired, the traction bars 14 and 16 can be serrated for additional traction. In addition to protecting against side slipping, it will be appreciated that the illustrated traction bars 14 and 16 further enhance forward tracking guidance and impart longitudinal torsional rigidity to the snowshoe 10 and allow the use of somewhat flexible materials in the flotation plate 12.

Figure 6:
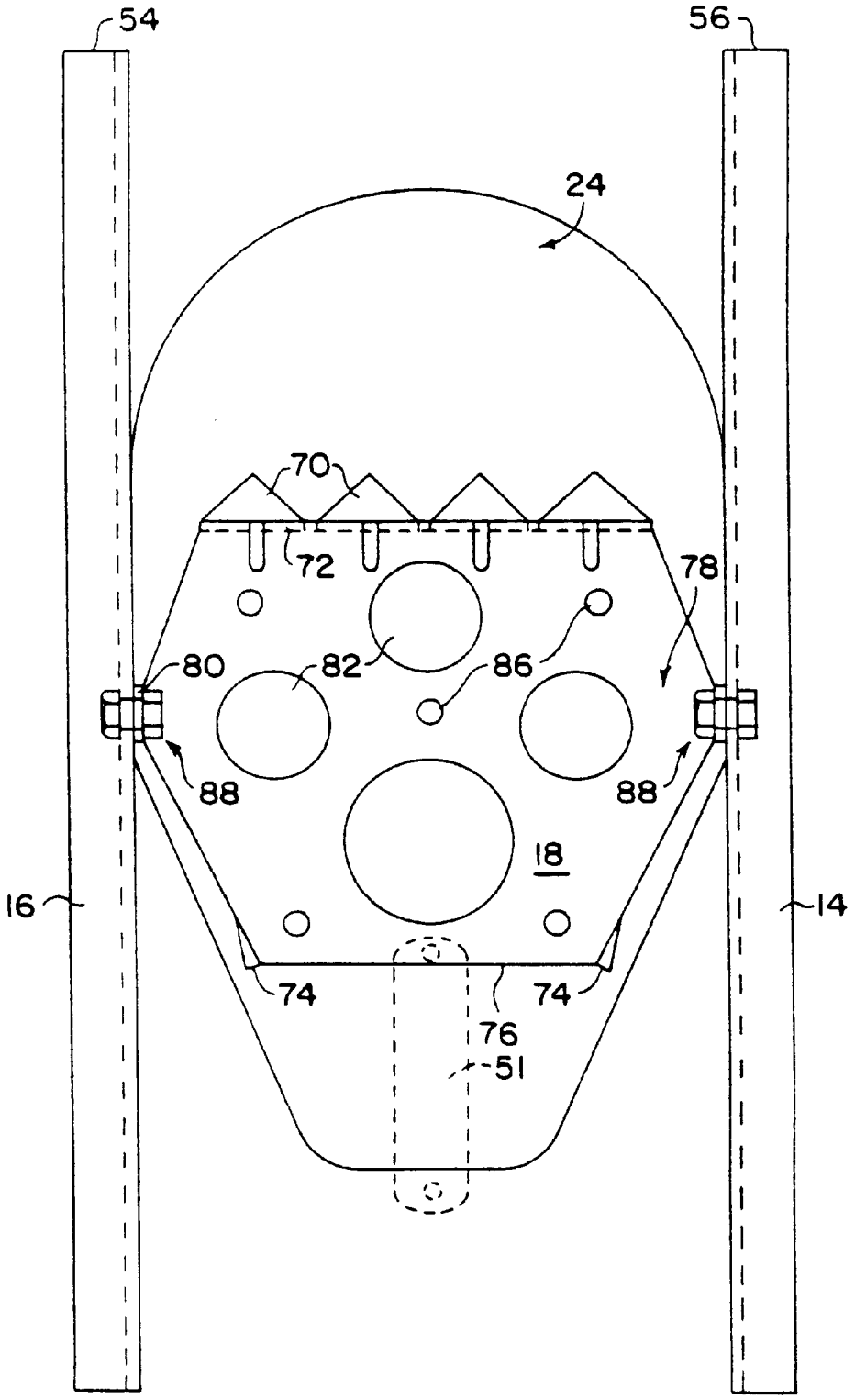
FIG. 6 is a bottom view showing the interconnection between the crampon and traction bars of the snowshoe of FIG. 2.

As shown most clearly in FIGS. 5–6, the traction bars 14 and 16 are spaced across the width of the snowshoe 10. Preferably, the traction bars 14 and 16 are spaced by a distance at least about as great as the width of the snowshoer's footgear 28. In the illustrated embodiment, the traction bars 14 and 16 are positioned adjacent the sides of cut-out 24 with the flanges 54 and 56 projecting outwardly. This positioning allows the crampon 18 to be attached to the traction bars 14 and 16 such that the crampon connection is short and stress on the connection is minimal as it is substantially totally in shear. The illustrated crampon 18 is connected directly to the traction bars 14 and 16 using pins 88 which allow for pivoting of the crampon 18 with the snowshoer's footgear 28.

The crampon 18, which can be formed from a number of materials, such as plate steel or aluminum, includes a number of front claws 70 at its front edge 72 and a number of rear claws 74 at its rear edge 76 for traction. The front claws 70 and rear claws 76 each define an obtuse angle, e.g., approximately 95°, relative to the crampon base for improved forward and rearward traction. In addition, the crampon includes a widened portion 78 provided with downwardly projecting wings 80 for attachment to the traction bars 14 and 16. The attachment pins 88 are positioned on snowshoe 10 such that more of the snowshoe weight is located rearwardly of the pins 88 so that the snowshoe tip portions 30 naturally rotate upwardly. To reduce weight, perforations 82 can be formed in crampon 18. Furthermore, in order to minimize icing of the crampon 18, the crampon 18 can be covered with a plastic laminate 84. The laminate 84 can be attached to the crampon base, for example, via rivets inserted through holes 86. If desired, a flexible strap 51 (shown in phantom in FIG. 6) may be used to interconnect the crampon 18 to flotation plate 12 so as to limit the pivoting range of the crampon 18.

The snowshoer's footgear 28 is attached to the snowshoe 10 by binding 20. The illustrated binding 20 includes a toe strap 90 which extends over a toe section 26 of footgear 28, an instep strap 92 which extends over an instep section 108 of footgear 28, a heel strap 94 which extends around heel section 95 of footgear 28 and foot wrap 96 which wraps about portions of footgear 28. Each of the straps 90, 92 and 94 is provided with an adjustable glide buckle 98 formed from substantially rigid plastic to allow for convenient and quick tightening of the straps 90, 92 and 94 by simply pulling on the strap ends. The foot wrap 96, which is preferably formed from a strong, flexible water repellent material, is attached to the crampon 18 using fasteners such as rivets or stitching, which can be the same fasteners used to attach the material 84 to the crampon 18. In the illustrated embodiment, the foot wrap is formed from vinyl coated polyester to provide the desired strength, flexibility and waterproof properties and resistance to cold cracking.

Figure 8:
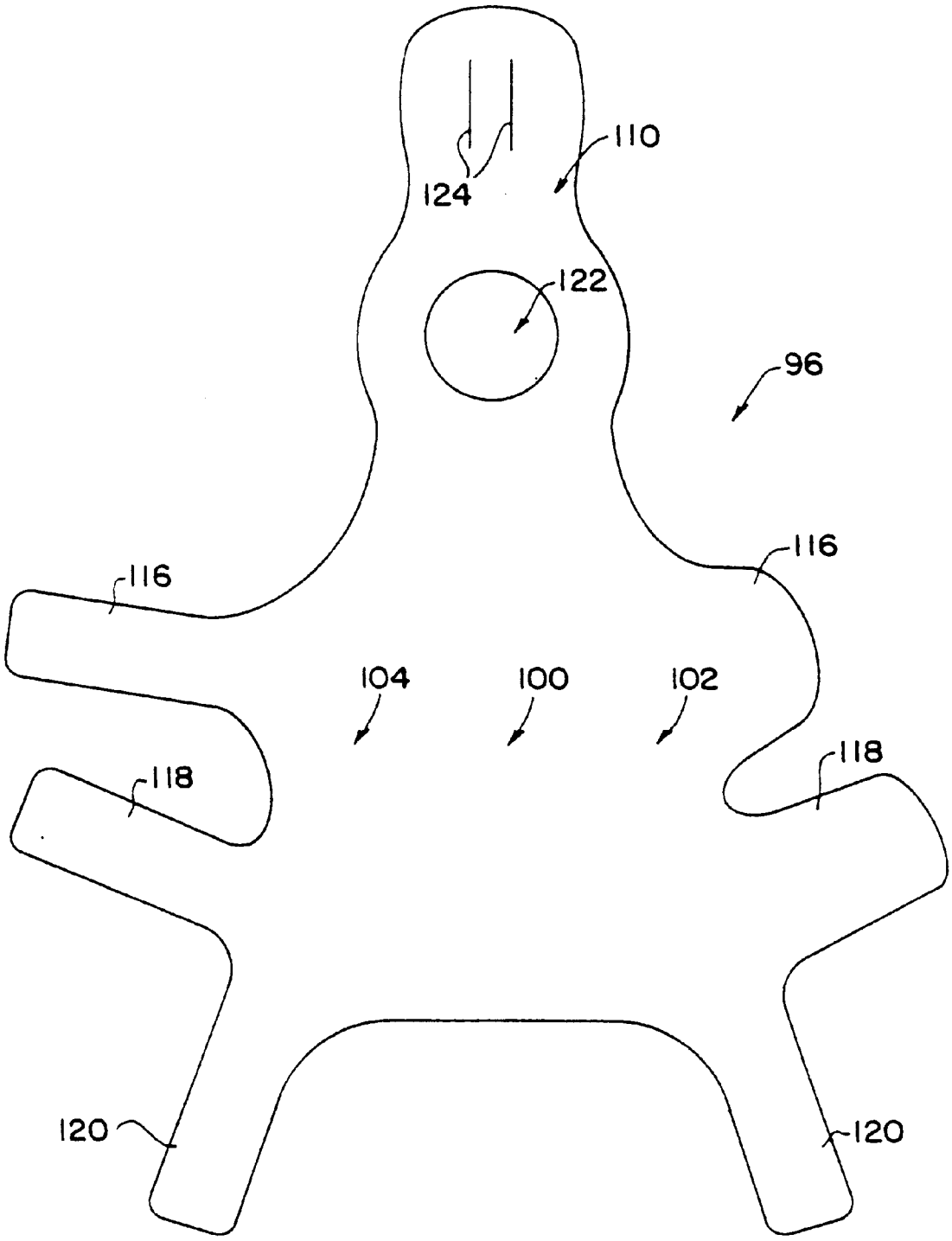
FIG. 8 is a top plan drawing showing the unfolded shape of the foot wrap of the snowshoe of FIG. 2.
Figure 9:
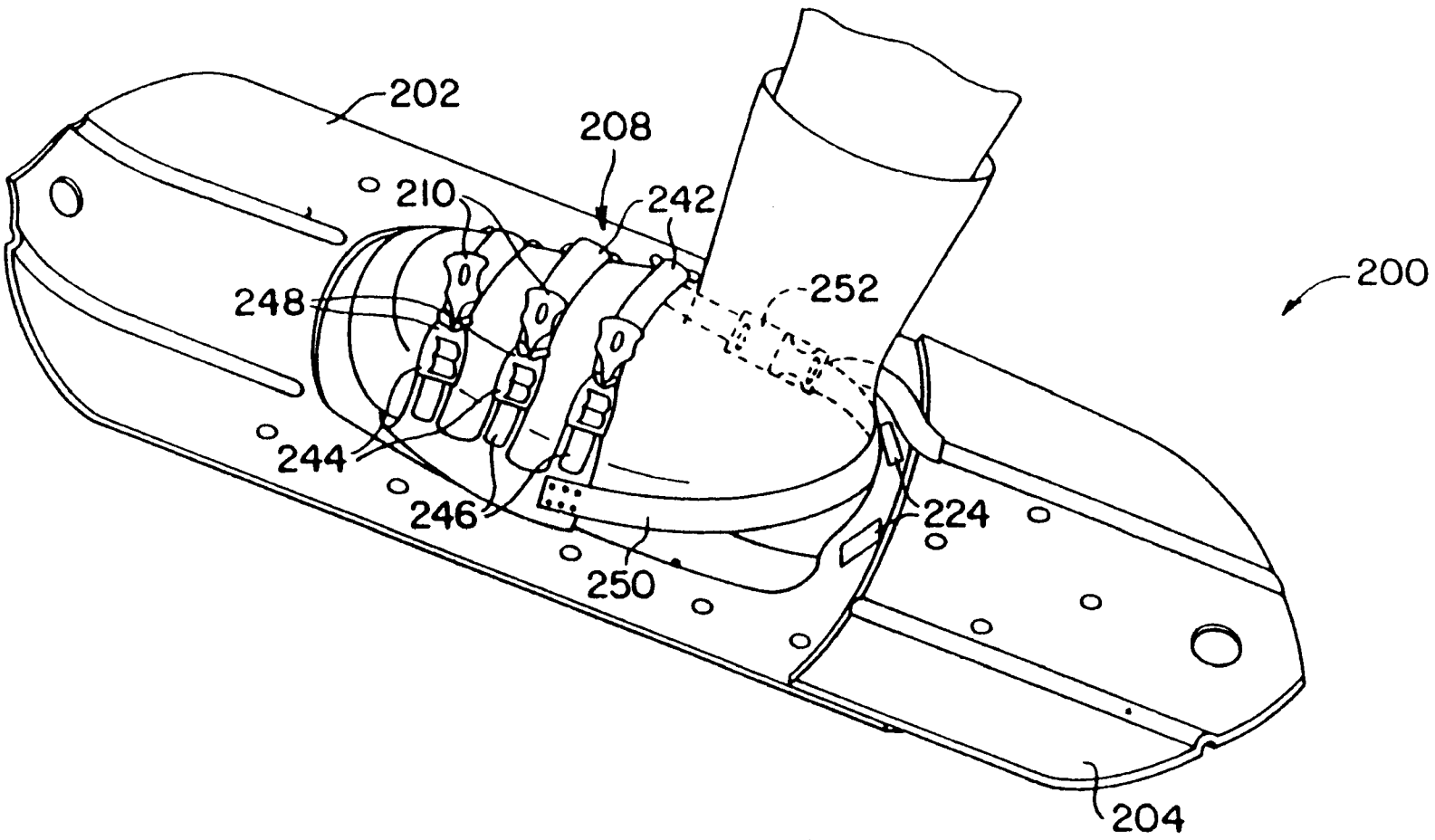
FIG. 9 is a perspective view of a snowshoe constructed in accordance with an alternative embodiment of the present invention showing attachment of a tail extender.
Figure 10:
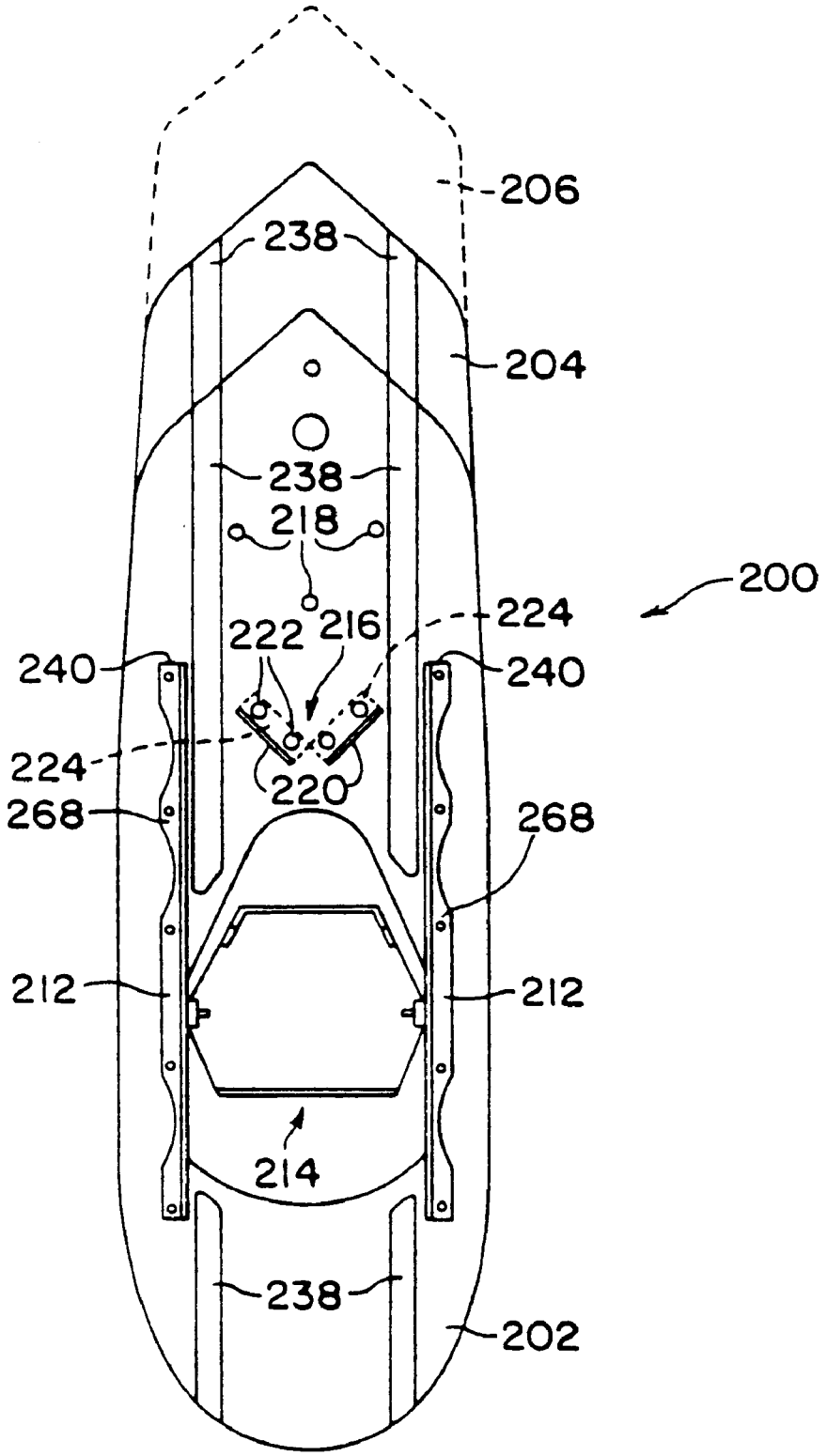
FIG. 10 is a bottom view of the snowshoe of FIG. 9 with an optional second tail extender shown in phantom.
Figure 11:
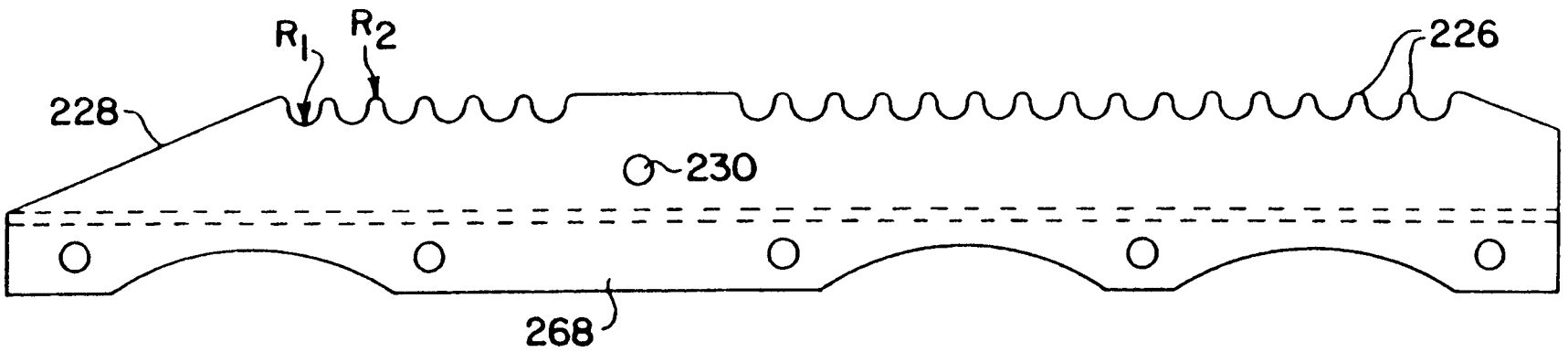
FIG. 11 is an elevational plan view of a traction bar where the dashed lines indicate where the traction bar will be bent to allow for attachment to the snowshoe flotation plate.

FIG. 8 shows a top plan view of the unfolded foot wrap 96. The foot wrap 96 includes a base portion 100 for attachment to the crampon 18, right 102 and left 104 side portions which wrap around the footgear 28 from the ball section 106 to the instep section 108 thereof, and a toe flap portion 110 which extends around the front edge 112 and over the toe section 26 of the footgear 28. In addition, the foot wrap 96 includes toe wings 116, instep wings 118 and heel wings 120 for attachment to the respective toe strap 90, instep strap 92 and heel strap 94. The wings 116, 118 and 120 on one side of foot wrap 96 are attached to the straps 90, 92 and 94 by threading the wings 116, 118 and 120 through one side of the buckles 98, doubling the wings 116, 118 and 120 over on themselves, and stitching or otherwise attaching the wings 116, 118 and 120 to themselves or adjacent portions of the foot wrap 96. The straps 90, 92, and 94 are then threaded through the other side of the buckles 98 to complete the attachment. On the opposite side of foot wrap 96, the wings 116, 118 and 120 can be connected directly to the straps 90, 92 and 94.

The toe flap portion 110 is widened and includes an opening 122 at the area corresponding to the front edge 112 of footgear 28. This allows the toe flap portion 110 to flare around the front edge 112 of footgear 28 so as to securely engage the same and enhance both lateral and longitudinal stability. The toe flap portion 110 is further secured by threading the toe strap 90 through slits 124 in toe flap portion 110.

The illustrated binding 20 thus provides excellent lateral foot stability and securely limits both longitudinal and vertical footgear movement. In addition, the binding 20 accommodates footgear 28 of various sizes and styles and is easily and quickly attached to or detached from footgear 28. The binding 20 is also suitable for use on either the left or the right foot, thereby allowing for interchange ability of the snowshoe 10.

Referring to FIGS. 9–15, an alternative embodiment of the snowshoe 200 of the present invention incorporating additional features is illustrated. Generally, the snowshoe 200 includes: a flotation plate 202 with detachable tail extenders 204 and 206; a binding 208 with novel gripping tabs 210; toothed traction bars 212; a de-icing crampon 214; and detachable brakes 216.

The flotation plate 202 can be formed from a semi-rigid material, such as plastic, and is generally shaped as described above in connection with the embodiment of FIGS. 2–8. However, the flotation plate 202 includes extended ribs 238 on front and rear portions thereof (as well as across the entire length of the tail extenders 204 and 206) for enhanced torsional rigidity, thereby allowing for a thinner and lighter flotation plate 202 than would otherwise be possible. Particular benefits are achieved by extending each of the ribs 238 past the front 239 and rear 240 ends of the traction bars 212 where large torsional forces are exerted. The ribs 238 are preferably positioned adjacent to the traction bars 212.

The snowshoe 200 allows the snowshoer to vary the snowshoe flotation characteristics as may be desired. This can be accomplished by attaching extenders to vary the snowshoe length and, hence, the snow contact surface area.

The illustrated snowshoe 200 is provided with two different lengths of tail extenders 204 and 206 which can be selectively attached to a rear portion of flotation plate 202. For example, the flotation plate can be about 22 inches long and the tail extenders 204 and 206 can provide for a total snowshoe length of 26 inches and 30 inches, respectively. These three lengths accommodate a great variety of conditions and applications.

Any suitable means may be utilized for attaching the tail extenders 204 and 206 to the flotation plate 202. However, it will be appreciated that the resulting connection must be strong enough to withstand the pressures exerted thereon in use and should allow for easy attachment and removal, preferably without the need to remove hand gear. As shown, the tail extenders 204 and 206 are removably attachable to the flotation plate 202 via a conventional nut and bolt 218 arrangement. The same fasteners which form the rearward most connection between the traction bars 212 and the flotation plate 202 can be used to attach the tail extenders 204 and 206 for increased strength. To further facilitate attachment/detachment, a mechanism for assisting in alignment of the flotation plate 202 and tail extenders 204 and 206 can be provided. For example, appropriately positioned mating members, e.g., tongue and groove or abutting shoulders, can be formed on opposing surfaces of the flotation plate 202 and tail extenders 204 and 206 to ensure proper registration. In the illustrated embodiment, the mating ribs 238 of the flotation plate 202 and tail extenders 204 and 206, respectively, assist in such alignment and further serve to maintain alignment during use.

The snowshoe 200 also includes detachable brakes 216 which work in cooperation with traction bars 212 to provide improved traction and resistance to forward and rearward sliding. The brakes 216 are formed from two plates 220 extending downwardly from the flotation plate 202 adjacent to the traction bars 212. The plates 220, which may be formed from aluminum, steel or other substantially rigid material, extend from the flotation plate slightly less distance than the traction bars 212, about ⅜", and can be oriented at about a 45° angle relative to the traction bars 212. In the illustrated embodiment, a space of about ¾ inch is provided between the two plates 220 and between each of the plates 220 and the adjacent traction bar 212.

The resulting "v" configuration of the brakes 216 is preferably oriented such that the widened end of the "v" is closest to the rear of the snowshoe. In this manner, a braking force is exerted during forward sliding due to constricted snow flow between the plates 220 and traction bars 216 and during rearward sliding due to constricted snow flow between the plates 220. The plates 220 are detachably connected to the flotation plate 202 via conventional nut and bolt 222 assemblies extending through flotation plate 202 and the flanges 224 of plates 220.

The construction of the traction bars 212 is generally similar to that of the traction bars described above in connection with FIGS. 2–8. However, the illustrated traction bars 212 are further provided with teeth 226 formed on the lower edges 228 thereof. The teeth 226 provide enhanced traction on icy surfaces and further assist in preventing undesired forward or rearward slipping. The illustrated teeth 226 are formed with curved extremities for improved fracture resistance. In particular, the illustrated teeth are formed with a radius of curvature $R_1$, of about ⅛ inch defining the lower extremities and a radius of curvature, $R_2$ of about 1/16 inch defining the upper extremities. Although other curvatures may be used, the illustrated geometry has been found to provide a good combination of traction and fracture resistance. In addition, in the illustrated embodiment, the tooth pattern is interrupted at the point of attachment 230 of the crampon 214 to the traction bars 212, where fracturing stresses are greatest, to further guard against fracture. The attachment flanges 268 of the traction bars 212 can be scalloped to further reduce weight.

The crampon 214 alleviates ice build-up problems associated with certain known crampon devices. The crampon 214 includes a rigid substrate 232, which may be formed from steel or other suitably strong material, constructed generally as is described above in connection with the embodiment of FIGS. 2–8, and a flexible diaphragm 234 attached to the substrate 232. The illustrated crampon has a number of forwardly angled claws 237 and rearwardly angled claws 239. Binding 208 is attached to the upper surface of substrate 232.

The substrate 232 includes a relatively large aperture 236. The aperture 236 reduces the total weight of the crampon 214 and also cooperates with the diaphragm 234 to pop-out any accumulated ice on the crampon 214 during use. Specifically, during use, the diaphragm 234 flexes into and out of the aperture 236 as a natural result of the snowshoer's striding motion thereby preventing ice build-up. The aperture's length, L, is preferably at least one inch and width, W, is preferably at least two inches. The dimensions of the illustrated aperture are at least about: L=2 inches; W=3 inches.

Figure 19:
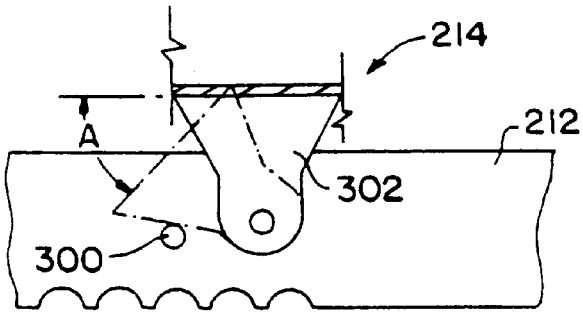
FIG. 19 is a side view showing a motion limiting protrusion constructed in accordance with the present invention.

A protrusion 300 for limiting the range of pivotal motion of the crampon 214 is shown in FIG. 19. The protrusion 300, which can be formed by a pin, rivet or the like extending from either or both of the traction bars 212, is positioned so as to contact pivot arm 302 of substrate 232 when crampon 214 reaches a selected limit angle, A, (shown in phantom) thereby preventing further rotation. The angle A is preferably between 60° and 120° and, in the illustrated embodiment, is between about 70° and 80°.

Figure 12:
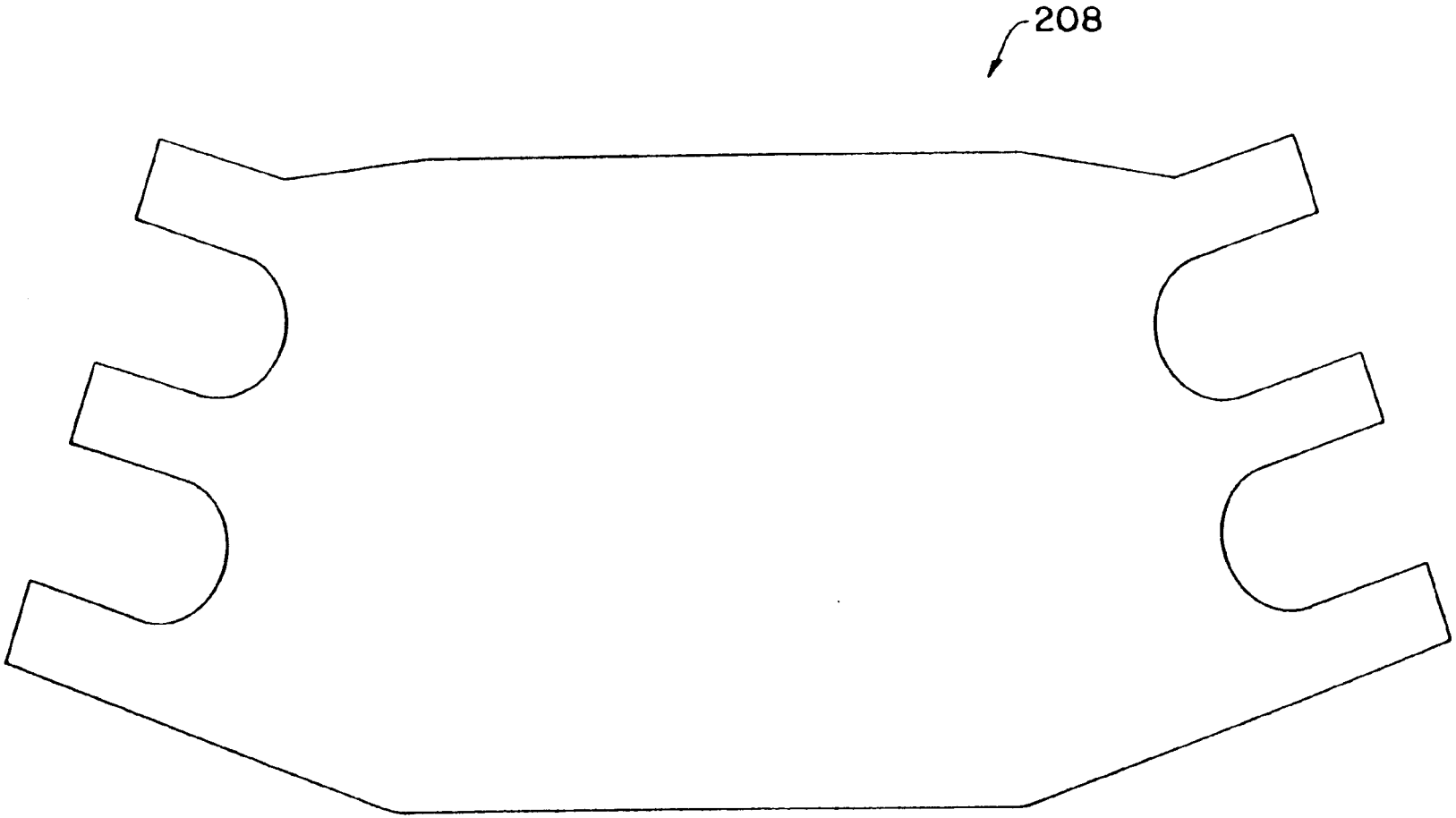
FIG. 12 shows the unfolded shape of the foot wrap of the snowshoe of FIG. 9.
Figure 13:
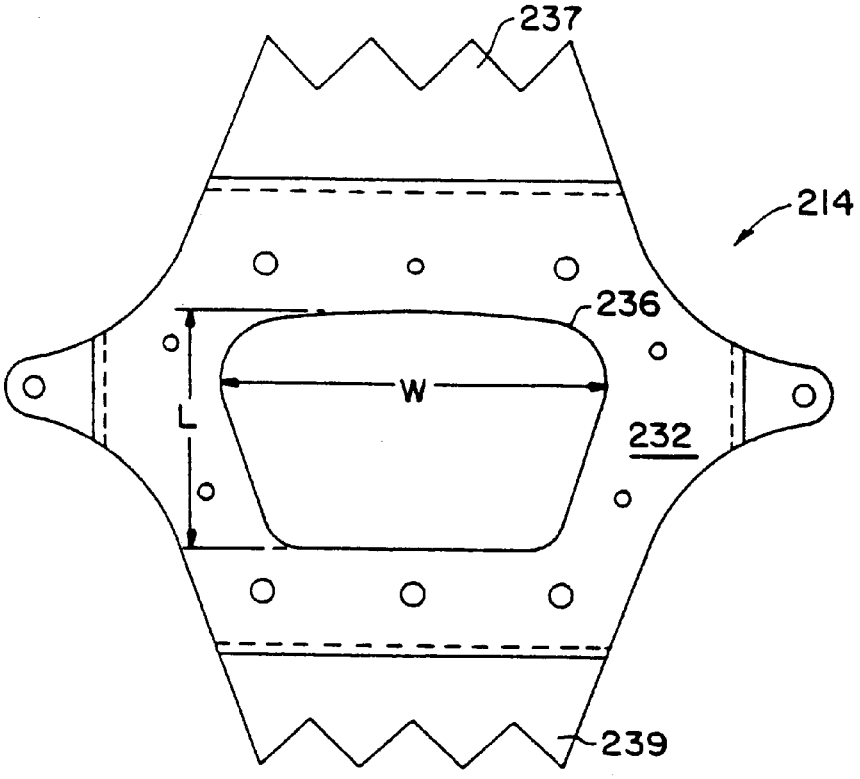
FIG. 13 shows the pre-formed shape of the crampon of the snowshoe of FIG. 9.

An alternative form of the binding 208 is also shown in connection with the embodiment of FIGS. 9–15 (shown in FIG. 12 without straps). The binding 208, like the binding described above in connection with the embodiment of FIGS. 2–8, can advantageously be formed in a unitary construction from a sheet of heavy weight vinyl coated nylon. However, the binding 208 is constructed in an open-toe style and includes three straps 242 distributed over the toe-to-ball regions of the snowshoer's foot. As discussed above, the straps 242 can be secured by conventional glide buckles 244 formed from substantially rigid plastic, wherein the straps are tightened by pulling on strap ends 246 and loosened by lifting buckle ends 248. The binding 208 further includes a heel strap 250 which is preferably secured by a conventional snap buckle 252 for convenient entry and exit.

Figure 14:
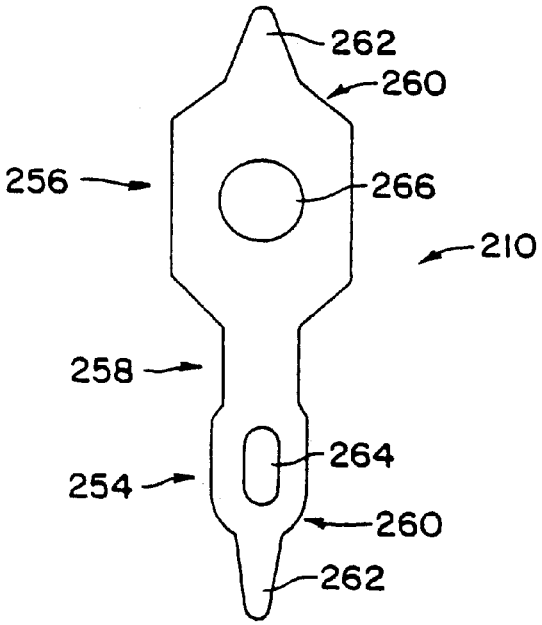
FIG. 14 shows the unfolded shape of the gripping tab of the snowshoe of FIG. 9.
Figure 15:
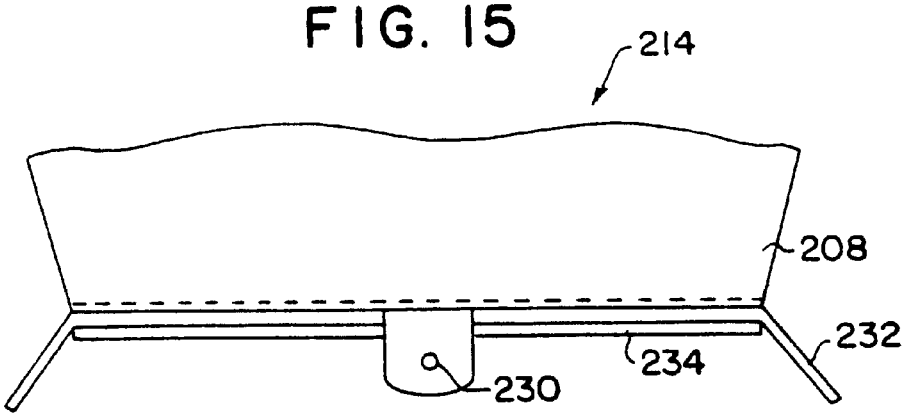
FIG. 15 is a side view of the crampon of the snowshoe of FIG. 9.

It has been found that it is sometimes difficult to manipulate the glide buckles 244, and particularly to lift buckle ends 248 to loosen the straps 242, when the snowshoer is wearing hand gear, the snowshoer's fingers are cold, or the snowshoer's finger dexterity is otherwise limited. This difficulty is alleviated in accordance with the present invention by providing gripping tabs 210 (FIGS. 9 and 14) attached to the buckle ends 248 via an aperture provided therein. The gripping tabs 210 can be formed in a unitary construction from a sheet of the same flexible, durable, tear resistant material used in constructing the binding 208 and crampon diaphragm 234. As shown in FIG. 14, gripping tab 210 includes a first widened portion 254, a second widened portion 256 and a narrowed portion 258 positioned therebetween. Each of the widened portions 254 and 256 is tapered towards an outer end 260 thereof and can further be provided with an outwardly extending tongue 262 to assist in threading as will be understood from the following description.

A gripping tab 210 is attached to a buckle 244 by threading the first widened portion 254 through the aperture in buckle end 248, wrapping the tab 210 about the buckle end 248 and pulling the second widened portion 256 through an opening 264 in the first widened portion 254 so that the narrowed portion 258 is seated in the opening 264. In this regard, the narrowed portion serves to lock the tab 210 in place. The opening 264 may be elongated as shown to facilitate threading of the second widened portion 256 therethrough. Additionally, a second opening 266 may be provided in the second widened portion 256 to facilitate gripping. It will be appreciated that the tab 210 is useful in a variety of hand operated adjustment mechanisms, such as zippers, other than the snowshoe strap buckle application shown.

Figure 16:
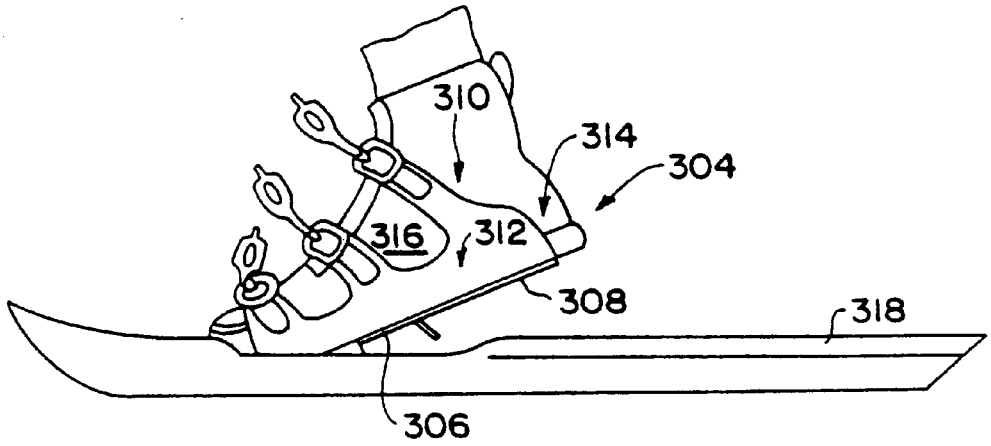
FIG. 16 is a perspective view of a snowshoe constructed in accordance with the present invention showing a binding incorporating a heel stabilizing extension.

Referring to FIG. 16, a perspective view of a binding 304 designed for improved foot stability is shown. The binding 304 comprises a binding support 307, including crampon portion 306, which can generally be constructed as described above, and heel stabilizing extension 308, and a footwrap assembly 310. The extension 308, which can be integral with the crampon portion 306 or formed separately for attachment to the crampon portion 306, extends rearwardly from the crampon portion beneath the arch 312 towards the heel 314 of the wearer's foot 316. The footwrap assembly 310 is generally constructed as described above, but is lengthened to correspond to the stabilizing extension 308. The illustrated binding 304 thus provides for enhanced foot stability, i.e. reduced side-to-side movement of the wearer's heel 314 during use.

Figure 17:
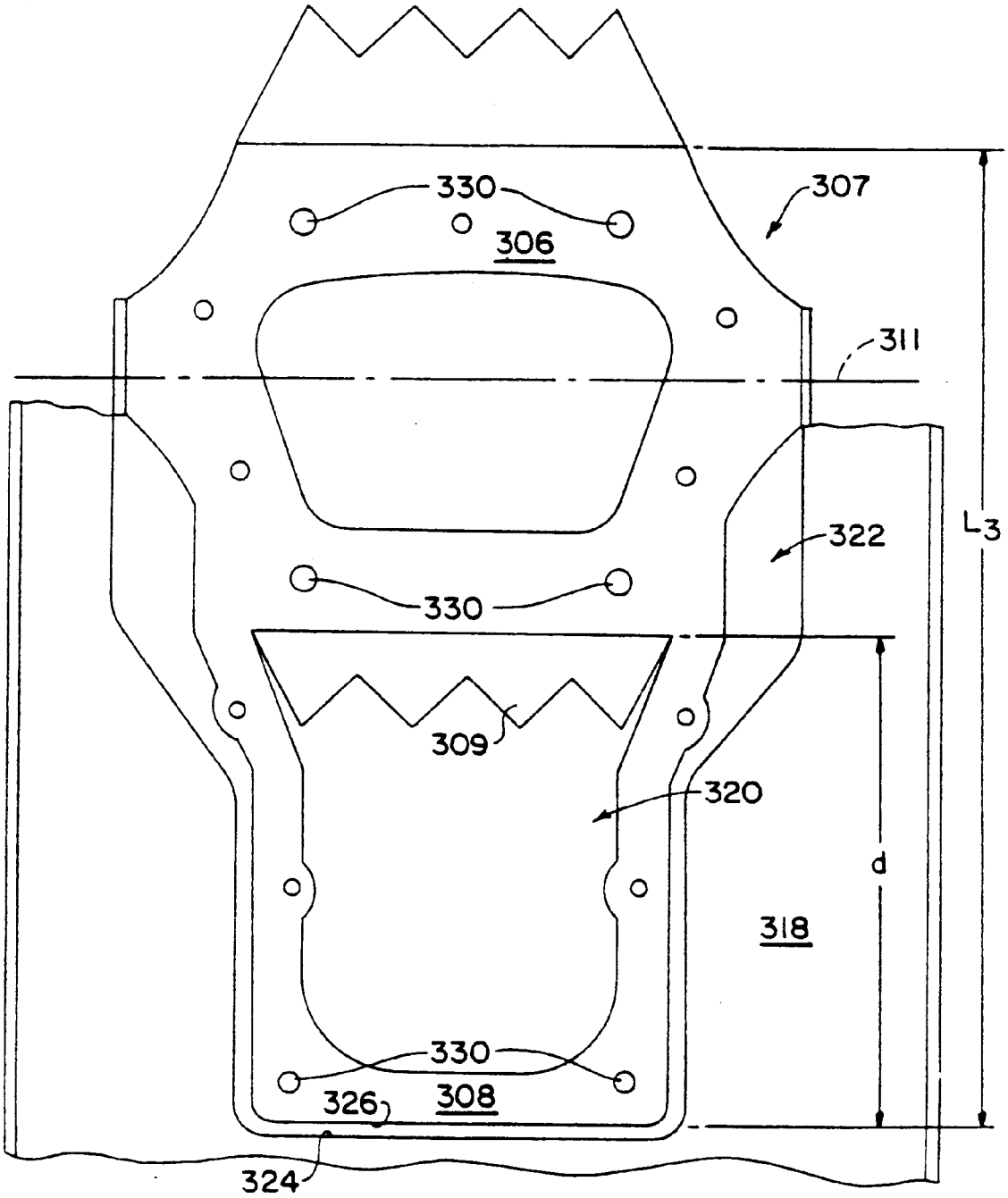
FIG. 17 is a bottom view of a binding support plate incorporating a heel stabilizing extension in accordance with an embodiment of the present invention.

FIG. 17 shows a bottom view of the crampon portion 306, heel extension 308 and a flotation plate 318 constructed in accordance with an embodiment of the present invention. Although omitted for illustration purposes, a flexible laminate such as discussed above is preferably provided across the extent of the crampon portion 306 and heel extension 308. The laminate is attached by rivets or the like attached via holes 330. The illustrated crampon portion 306 and heel extension 308 are integrally formed from a single plate of rigid material such as aluminum, steel or the like. The heel extension 308 is provided with a central opening 320 to reduce material requirements and weight, and further to allow for deicing due to flexing of the superimposed laminate (not shown).

If desired, the heel extension can overlie the flotation plate 318. However, it has been found that such a design can result in distracting noise and unnecessary binding/flotation plate contact. Thus, in the illustrated embodiment, opening 322 is formed in flotation plate 318 to correspond to the shape of extension 308. Preferably, rear edge 324 of opening 322 is disposed in close proximity to rear edge 326 of extension 308 so that the wearer's heel 314 abuts against flotation plate 318 during use and does not extend through opening 322.

For enhanced stability, the binding support 307 preferably underlies a majority of the snowshoer's foot 316. In particular, the support 307 preferably extends beneath the arch 312 of the wearer's foot 316 to the wearer's heel 314. Thus, the length $L_3$ of support 307 is preferably at least six inches and, in the illustrated embodiment, is about 8.75 inches. In addition, the heel extension 308 extends rearwardly from traction teeth 309 a distance, d, which is preferably at least about two inches and, in the illustrated embodiment is about 3.75 inches. The support 307 is further disposed relative to pivot axis 311 so that most of the support's length is positioned rearwardly of axis 311 and, preferably, so that at least about ⅔ of the support's length is positioned rearwardly of axis 311.

Figure 18:
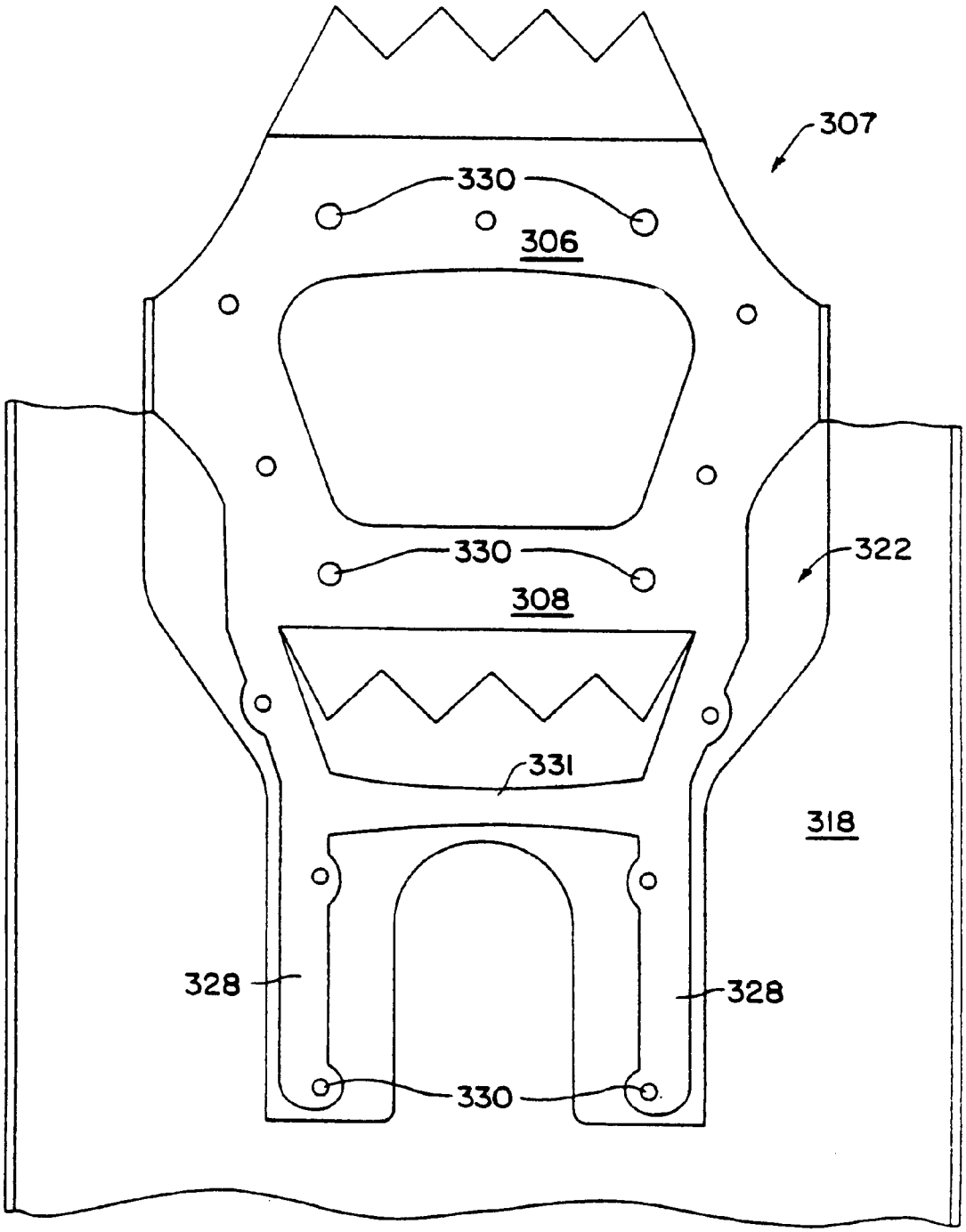
FIG. 18 is a bottom view of a binding support plate incorporating a heel stabilizing extension in accordance with a further embodiment of the present invention.

FIG. 18 shows an alternative embodiment of the crampon portion 306, extension 308 and flotation plate 318 which accommodates small feet. During use, it is important that the wearer's foot does not extend through opening 322. As shown in FIG. 18, this can be ensured by providing extension 308 in the form of two elongated members 328. In this manner, opening 322 can be shaped so that flotation plate 318 extends forwardly between the elongated members 328 to provide heel support for shorter boots. In the illustrated embodiment, a cross-member 331 is provided between elongated members 328 for improved strength.

FIGS. 20–24 show a snowshoe 400 constructed in accordance with a further alternative embodiment of the invention. The snowshoe 400 is similar in many respects to the snowshoes described above, but includes a number of additional or modified features as will be described below.

The illustrated snowshoe 400 includes a three-point attachment mechanism 402 that works in conjunction with a tongue and groove connection 403 to provide superior performance and allow for easy attachment and detachment of any one of the tail extenders 404. When the snowshoe 400 is used in a walking or shuffling mode, the tail extender 404 tends to impact the snow first with each step or to bear a disproportionate share of the load as weight is shifted from one foot to the other. If only one or two attachment points are utilized in connecting the tail extender 404, then loading of the tail extender 404 can cause the extender 404 to tend to pivot about an axis of the attachment point(s), thereby placing additional stress on the connection.

The illustrated embodiment employs at least three attachment points, for example, two side attachment points 406 and 408 and a center attachment point 410, arranged in a non-linear fashion, i.e., arranged so as to define a triangular connection region. In this manner, the establishment of a pivot axis extending through all of the attachment points 406, 408 and 410 is avoided and the torsional rigidity of the attachment mechanism is enhanced. In the illustrated embodiment, the side attachment points 406 and 408 are located at the rearward ends of the traction bars 412 and 414. The center attachment point 410 is located at the rearward tip of the flotation plate 416 of snowshoe 400.

Each of the side attachment points 406 and 408 is defined by a spool and slot engagement device for sliding engagement and disengagement. Each of the spool and slot engagement devices includes a spool element 418 (FIG. 24) mounted on one of the flotation plate 416 and tail extender 404 for slidingly engaging a slot 428 on the other of the flotation plate 416 and tail extender 404. In the illustrated embodiment, the spool elements 418 extend upwardly from the tail section of flotation plate 416 and are mounted on flanges 422 of the respective traction bars 412 and 414 by way of a bolt, rivet or the like extending through the floatation plate 416. Each spool element 418 includes a base flange 422 and an upper flange 424 separated by an axle 426 so as to define a space between the flanges 424 and 426 for securely receiving the tail extender 404. The spool elements 418 engage slots 428 formed on a forward portion of the tail extender 404. Each of the slots 428 includes a widened forward portion 430 FIG. 22) that is dimensioned to receive the upper flange 424 of the spool element, and a rearward portion 432 (FIG. 22) that is dimensioned to receive the axle 426 of the spool element 418 but is narrower than the upper flange 424.

The center attachment point 410 is defined by a hand clamp 434. The hand clamp 434 includes a threaded bolt 436 inset into mounting flange 438. Preferably, a suitable mechanism is provided to prevent rotation of the bolt 436 relative to the flange 438. In the illustrated embodiment, a pin (not shown) extending through the bolt 436 and into a slot formed in the flange 438 is provided for this purpose. The mounting flange 438, which is an integrally molded portion of the tail extender 404 in the illustrated embodiment, defines a lip surface 440 and a shoulder surface 442. When the tail extender 404 is coupled to the flotation plate 416, the trailing edge of the plate 416 is progressively received over the lip surface 440 until the plate 416 abuts or substantially abuts against the shoulder surface 442. Concurrently, the bolt 436 is received within a slot 444 formed on the trailing edge of plate 416. The illustrated shoulder surface 442 is curved from side-to-side to substantially match the shape of the trailing edge of the plate 416. Once the plate 416 and tail extender 404 are thereby properly engaged, a nut 446 is hand threaded downwardly on bolt 436 so that the plate 416 is captured between the lip surface 440 and the nut 446, thereby securing the tail extender 404. In this regard, the flange 447 of nut 446 mates with a corresponding recess formed on plate 416 for secure coupling.

The coupling of the tail extender 404 to the flotation plate 416 in the illustrated embodiment also involves the tongue and groove connection 403. The tongue and groove connection 403 operates by engagement of the tongue flange 448 of tail extender 404 within the opening 450 formed in plate 416. The tongue flange 448, which can be molded as an integral portion of the tail extender 404, operates in a manner analogous to the mounting flange 438 described previously. In particular, as the plate 416 and tail extender 404 are coupled, a portion of the plate 416 (i.e., the front edge of opening 450) is received over lip surface 452 of tongue flange 448 until the plate portion abuts or substantially abuts against shoulder surface 454 of tongue flange 448. It will thus be appreciated that the lip surface 452 bears against the underside of plate 416 to maintain the plate 416 and tail extender 404 in a close abutting relationship.

To summarize, the coupling of the tail extender 404 to the flotation plate 416 is accomplished as follows. Initially, the tail extender 404 is positioned over the flotation plate 416 so that the upper flanges 424 of the spool elements 418 are received within the widened portions 430 of the slots 428 and the tongue flange 448 of the tail extender 404 is received within opening 450 of plate 416. The tail extender 404 is then moved forwardly relative to plate 416 so that axles 426 are received within the narrowed portions 432 of slots 428 of the tail extender 404 and bolt 436 is received within slot 444 of plate 416 until plate 416 is disposed adjacent to shoulder surfaces 442 and 454. The tail extender 404 is then clamped in place using nut 446. The coupling thus formed reduces stress on the attachment points and maintains a closely abutting relationship across the width of the snowshoe 400 such that snow is substantially prevented from penetrating between the tail extender 404 and the plate 416.

The illustrated snowshoe 400 also shows an alternative configuration and construction of the binding and binding crampon interface. The crampon 456 includes a base plate 458 that is generally constructed in accordance with the description of the embodiments discussed above. However, the footwrap 460 is provided with a transverse slit 462 to receive the tail portion 464 of the crampon 456 such that the footwrap 460 is disposed beneath the base plate 458 only in the area of the tail portion 464. The footwrap 460 thus cushions the interface between the tail portion 464 and the plate 416 to reduce or substantially prevent wear and distracting contact noise. Relatedly, the alignment of the attachment rivets 466 with openings 468 in plate 416 can be seen in FIG. 21. The illustrated footwrap 460 includes rounded longitudinal side openings 465 for securely accommodating footgear of various sizes and styles.

Figure 20:
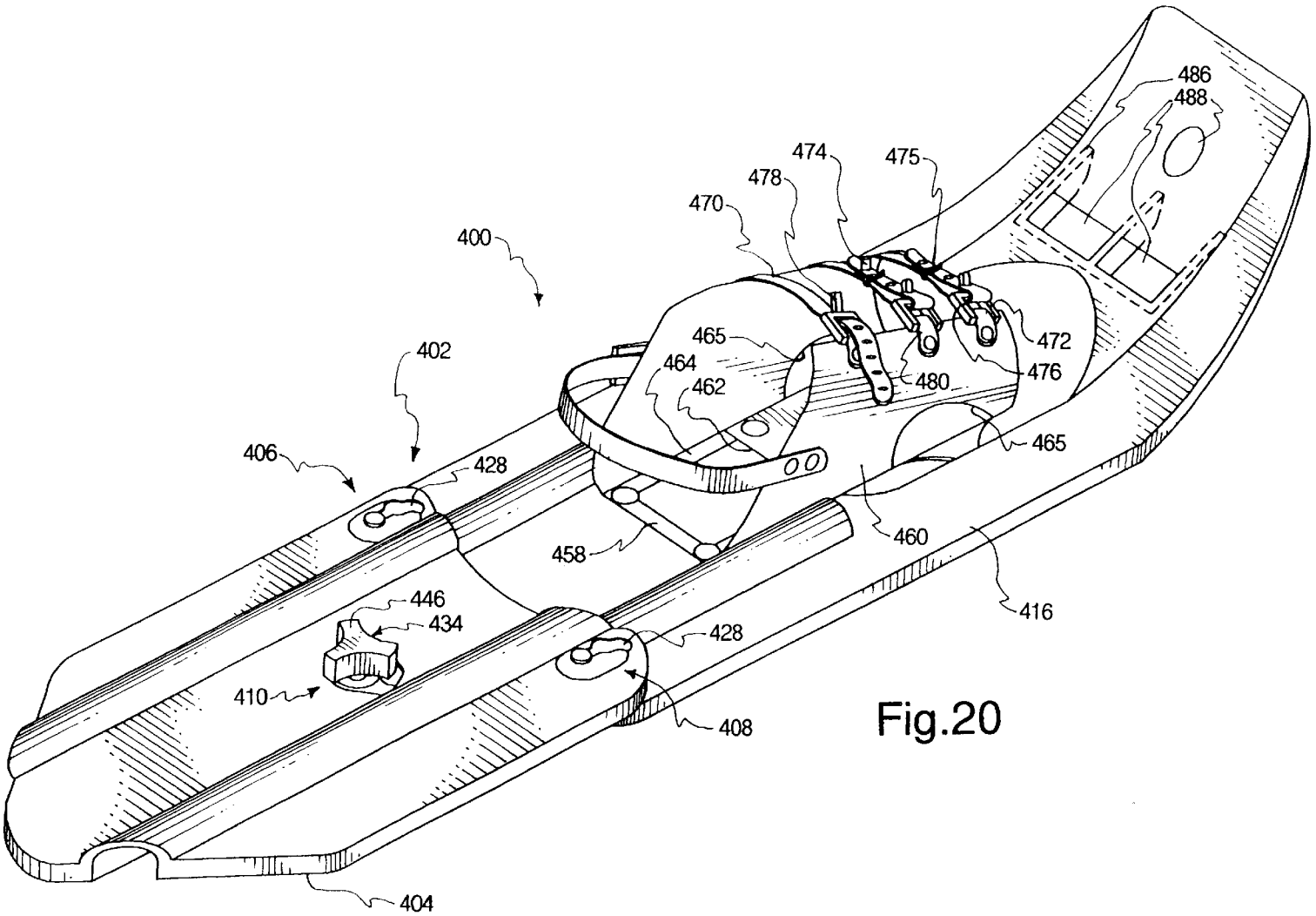
FIGS. 20 and 21 are top and exploded bottom perspective views, respectively, of a snowshoe constructed in accordance with a further embodiment of the present invention.

As shown in FIG. 20, the snowshoe 400 includes a number of strap mechanisms that can be easily operated, even when wearing mittens on gloves. The illustrated embodiment includes three over-the-foot strap mechanisms and one around the heel strap mechanism. Each of the mechanisms includes a flexible and somewhat elastic strap 470, formed from plastic, rubber or the like (for example, injection molded urethane), and a strap receiver element 472. Each strap 470 includes a number of sizing apertures 473, a retainer clip 475 and a removable nub 474 that can be inserted into any of the apertures 473. Each receiver element 472 includes a threading slot 476 and a finger 478. The straps 470 are attached to one side of the footwrap 460 using rivets or the like. The receiver elements 472 are attached to the opposite side of the footwrap 460 by forming tongue portions 480 in the footwrap 460, threading the tongue portions 480 through the slots 476 of the receiver elements 472, doubling the tongue portions 480 back over the footwrap 460 and then riveting or otherwise attaching the tongue portions 480 to the footwrap 460.

To prepare the strap mechanisms for use, the user threads the strap end through the slot 476 and then inserts the nub 474 into one of the apertures 473 of the threaded strap portion. Thereafter, the nub 474 prevents complete unthreading of the strap 470 thereby simplifying use of the binding. To use the binding, the user inserts his or her footgear inside of the footwrap 460 and the straps 470. The user then grips the threaded strap portion and pulls the footwrap 460 tight about the footgear. The footwrap 460 is secured by inserting the finger 478 through one of the apertures 473 and inserting the remaining threaded strap portion into the clip 475. The process is reversed to release the binding.

Figure 25:
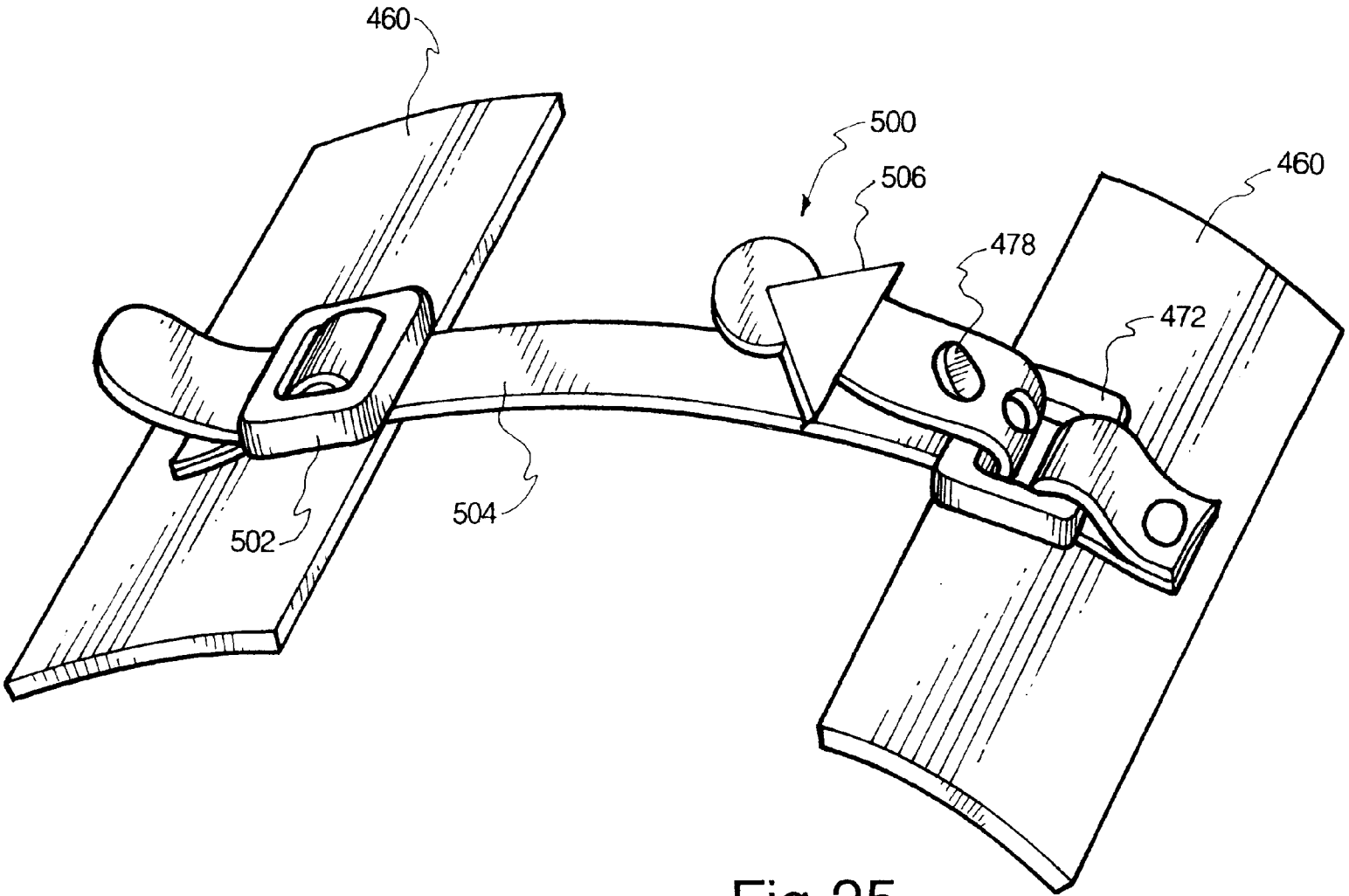
FIG. 25 is a perspective view of an alternative binding strap assembly for the snowshoe of FIGS. 20 and 21.

FIG. 25 shows an alternative binding strap assembly 500. The assembly 500 includes a conventional, single bar slider buckle 502 attached to one side of the footwrap 460 and a strap receiver element 472, as described above, attached to the other side of the footwrap 460. The buckle 502 and element 472 can be attached to the footwrap 460 by way of an adhesive, by heat fusion, by RF welding, by using rivets or the like, or by any other suitable method. A flexible strap 504 extends through the element 472, across the wearer's foot and through the buckle 502. The strap 504 includes a molded stop 506 that substantially prevents the strap end from slipping through the element 472 and thereby becoming unthreaded.

In operation, the wearer can use the buckle 502 to make a one-time or periodic adjustment to the strap 504 so as to allow for insertion of the wearer's footgear into the binding with the stop 506 positioned against element 472. Any excess strap portion pulled through the buckle can then be cut-off or secured to the binding to minimize distraction during use. The assembly 500 is then tightened by grasping the stop 506, pulling the flexible strap 504 through the element 472 until the desired tightness is achieved, and then inserting the finger 478 of element 472 through an opening in strap 504 to secure the strap 504. The elasticity of the strap 504, in combination with the binding geometry and strap pressure, effectively secures the strap 504 in this configuration. Once the strap 504 has been customized for a particular wearer by adjusting the buckle 502, the assembly can be operated by simply pulling on the stop 506.

Moreover, since the strap 504 is not attached to the footwrap 460, replacement straps can be readily installed in the event of strap damage or wear.

Figure 21:
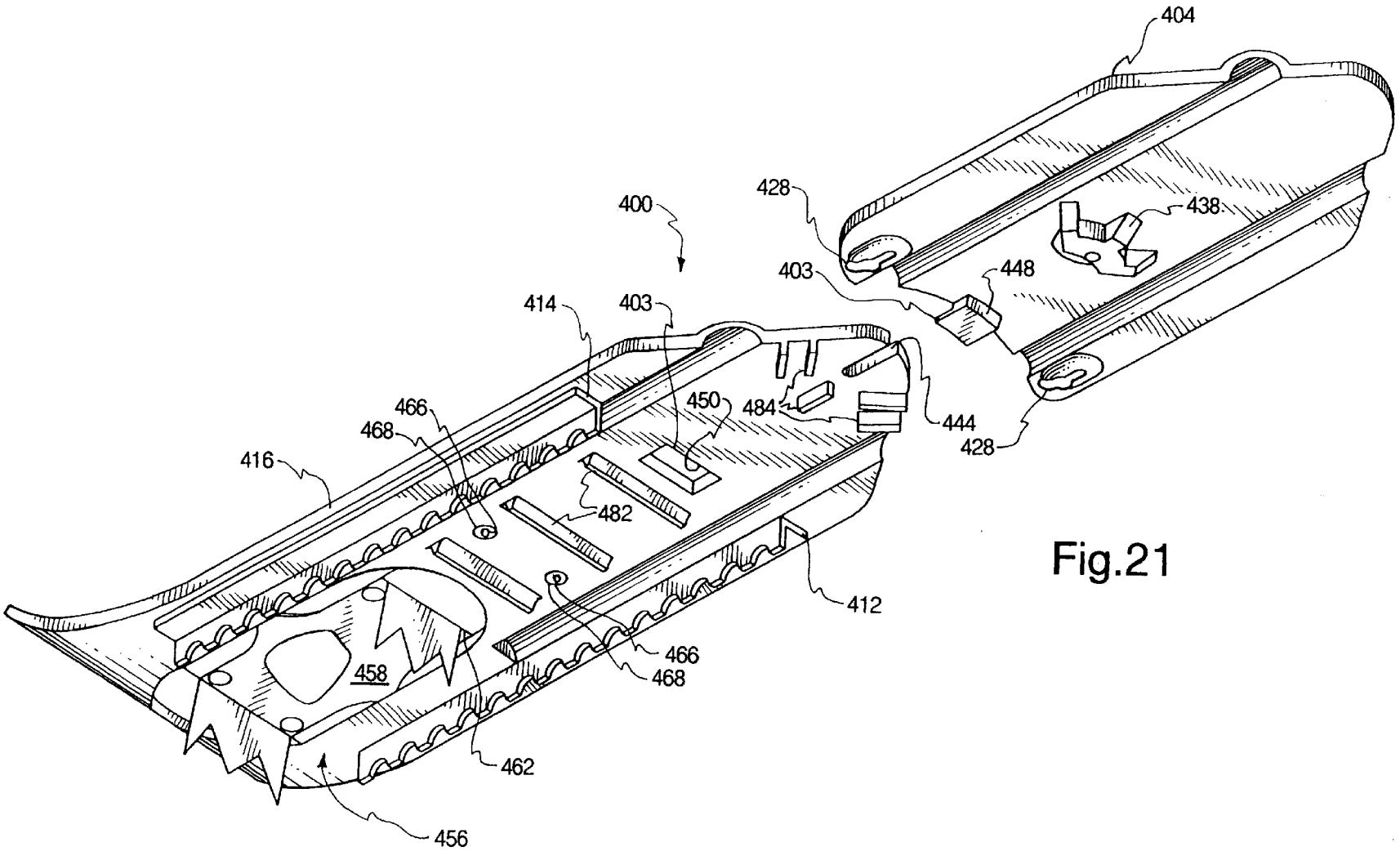
Figure 22:
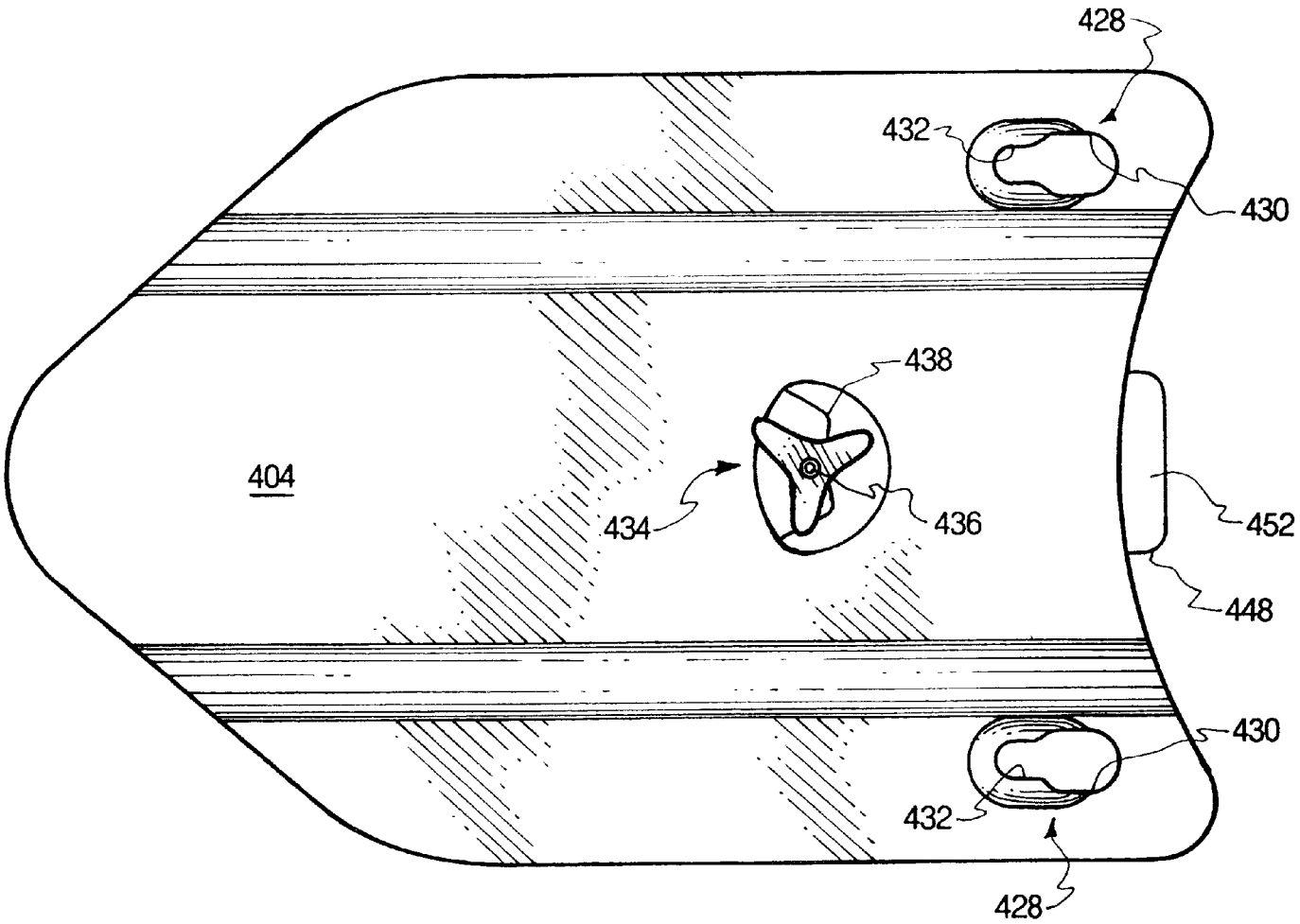
FIG. 22 is a top view of a tail extender for use in connection with the snowshoe of FIGS. 20 and 21.
Figure 23:
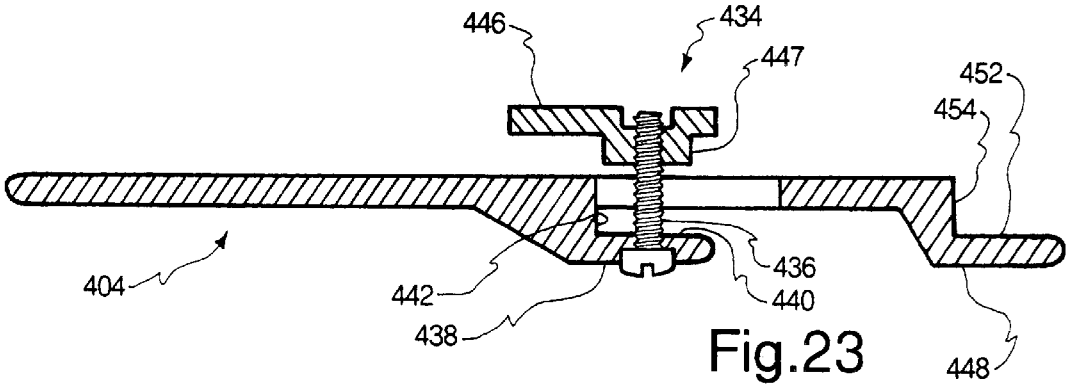
FIG. 23 is a side cross-sectional view of the tail extender of FIG. 22.
Figure 24:
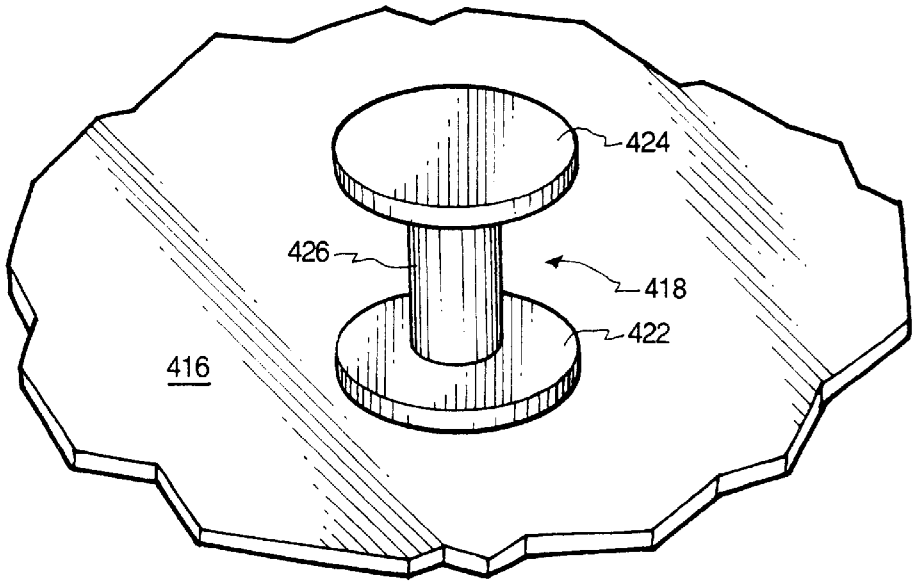
FIG. 24 is a perspective view of a tail portion of the snowshoe of FIGS. 20 and 21 showing the attachment spool.

FIGS. 20–21 show additional features of this embodiment of the snowshoe 400. Specifically, the snowshoe 400 is optionally provided with three molded brakes 482 oriented substantially perpendicular to the traction bars 412. The brakes 482 extend downwardly from the flotation plate 416 a distance slightly less than that of the traction bars 412 and have a narrow bottom profile to penetrate snow and provide a braking force against forward and rearward sliding. Also shown are a number of wear lugs 484 on the trailing edge to extend snowshoe life. The lugs are positioned and angled to accommodate the mounting flange 438 of the tail extender 404. Similar lugs can be provided on the tail extender 404.

The bottom surface of the flotation plate 416 and/or the tail extender 404 can be provided with a roughened texture, i.e., via molding or sandblasting, to impart improved frictional characteristics. Finally, FIG. 20 also shows ridges 486 (in phantom) that extend from the bottom of plate 416 to provide enhanced rigidity in the toe section of flotation plate 416 and optional openings 488 that provide advantageous hanging and carrying options.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A snowshoe apparatus, comprising:

a flotation plate to provide a snow contact surface area, the flotation plate comprising a rear portion having a first width;

a tail extender detachably coupled to the flotation plate, the tail extender being adjustable relative to the flotation plate to selectively vary the snow contact surface area of the snowshoe, the tail extender comprising a second width substantially equal to the first width of the flotation plate, the rear portion of the flotation plate and the front portion of the tail extender being arranged in an overlapping relationship along the first and second widths.

2. A snowshoe apparatus according to claim 1 wherein the rear portion of the flotation plate and the front portion of the tail extender are shaped to substantially match one another and allow movement relative to one another.

3. A snowshoe apparatus according to claim 1 wherein the flotation plate and the tail extender are secured to one another at multiple locations.

4. A snowshoe apparatus according to claim 1 wherein the flotation plate and the tail extender are coupled together at multiple locations, the multiple locations being arranged in a triangular pattern.

5. A snowshoe apparatus according to claim 1, further comprising a plurality of channels extending longitudinally along the flotation plate an the tail extender, respectively, to allow longitudinal movement of the tail extender relative to the flotation plate along the channels.

6. A snowshoe apparatus according to claim 1, further comprising a plurality of tongue-and-groove connectors to interconnect the flotation plate and the tail extender.

7. A snowshoe apparatus according to claim 1 wherein the overlapping relationship of the flotation plate and the tail extender prevents any substantial penetration between the tail extender and the flotation plate.

8. A snowshoe apparatus, comprising:

a flotation plate to provide a snow contact surface area, the flotation plate comprising a rearward portion; and a tail extender, detachably coupled to the flotation plate, the tail extender being adjustable relative to the flotation plate to selectively vary the snow contact surface area of the snowshoe, the tail extender including a forward portion, the rearward portion of the flotation plate and the forward portion of the tail extender defining an interconnection area, the rearward portion of the flotation plate and the forward portion of the tail extender being coupled together at multiple locations along the interconnection area.

9. A snowshoe apparatus, comprising:

a flotation plate to provide a snow contact surface area, the flotation plate having a longitudinal length and a transverse width;

traction bars coupled to the flotation plate, the traction bars comprising first and second longitudinal traction bars to resist lateral movement of the snowshoe through snow and to provide torsional rigidity to the snowshoe, the first and second longitudinal traction bars being oriented in a substantially parallel longitudinal relationship to facilitate forward motion of the snowshoe through snow, each of the traction bars extending downwardly from the flotation plate and terminating at a bottom edge to define a traction bar depth, the bottom edge of each of the traction bars having a width that is less than the traction bar depth, the traction bars being configured to readily penetrate downwardly into snow when walking and resist transverse sliding when traversing a sloped snow surface.

10. A snowshoe apparatus according to claim 9 wherein the bottom edge of each of the traction bars comprises a plurality of teeth to enhance traction on icy surfaces.

11. A snowshoe apparatus according to claim 9 wherein each bottom edge of the traction bars comprises a plurality of teeth, each tooth terminating at an edge having a radius of curvature.

12. A snowshoe apparatus according to claim 9 wherein the bottom edge of each of the traction bars comprises a plurality of teeth, the teeth being formed in an interrupted pattern along each of the bottom edges of the traction bars.

13. A snowshoe apparatus according to claim 9 wherein each of the traction bars comprises an attachment flange extending perpendicularly relative to the traction bar for securing the traction bar to the flotation plate.

14. A method of adjusting the snow contact surface of a snowshoe, comprising:

providing a snowshoe comprising a flotation plate and a tail extender coupled to the flotation plate;

positioning the tail extender at a first location relative to the flotation plate;

securing the tail extender to the flotation plate at the first location;

unsecuring the tail extender from the flotation plate at the first location to allow longitudinal movement of the tail extender relative to the flotation plate;

moving the tail extender longitudinally relative to the flotation plate to a second location;

securing the tail extender to the flotation plate at the second location.

* * * * *